US008118389B2

(12) United States Patent
Sasayama

(10) Patent No.: US 8,118,389 B2
(45) Date of Patent: Feb. 21, 2012

(54) IMAGE RECORDING DEVICE AND IMAGE RECORDING METHOD

(75) Inventor: Hiroyuki Sasayama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 401 days.

(21) Appl. No.: 12/424,235

(22) Filed: Apr. 15, 2009

(65) Prior Publication Data

US 2009/0262158 A1 Oct. 22, 2009

(30) Foreign Application Priority Data

Apr. 16, 2008 (JP) ..... 2008-106880

(51) Int. Cl.
*B41J 29/38* (2006.01)

(52) U.S. Cl. ..... 347/14; 347/19
(58) Field of Classification Search ..... 347/15, 347/19, 14
See application file for complete search history.

(56) References Cited

FOREIGN PATENT DOCUMENTS

JP 05220977 A * 8/1993
JP 2942048 B2 6/1999

* cited by examiner

*Primary Examiner* — Laura Martin
(74) *Attorney, Agent, or Firm* — Birch, Stewart, Kolasch & Birch, LLP

(57) ABSTRACT

An image recording device comprises: a recording head that has a plurality of recording elements; non-uniformity information acquiring unit that acquires non-uniformity information of each recording element by using a test pattern; non-uniformity correction coefficient calculating unit that calculates a non-uniformity correction coefficient value for each density as recording characteristics of the recording element; misfiring correction coefficient calculating unit that calculates a misfiring correction coefficient value for each density in a case where a nearby recording element is misfiring as the recording characteristics of the recording element; selecting unit that selects one of the recording characteristics for each recording element based on pixel density data of image data and the misfiring information detected by misfiring information detecting unit; and correction processing unit that corrects the pixel density data using the recording characteristics selected by the selecting unit.

7 Claims, 21 Drawing Sheets

FIG. 9

A

REPEAT FOR ENTIRE WIDTH (ALL NOZZLES). S130

(A) WHEN THERE IS NO MISFIRING NOZZLE

(I) ADD THE IDEAL POSITION INTERVAL VALUE L TO THE POSITION ERROR (err_xx) OF EACH NOZZLE (LEFT: −L, CENTER: 0, RIGHT: +L) AND CONVERT THE VALUE TO AN ABSOLUTE VALUE (a[3]).

(II) CALCULATE THE CORRECTION COEFFICIENT (p[3]) USING THE POSITION ERROR INFORMATION (a[3]).
(*DO NOT CORRECT THE POSITION IF THE POSITION ERROR IS WITHIN THE THRESHOLD VALUE 0.1 μ.)

LEFT NOZZLE:

$$p[0]=\frac{\prod_{k=0,1,2} a[k]}{a[0]\cdot\prod_{k=1,2}(a[k]-a[0])}$$

CENTER NOZZLE:

$$p[1]=\frac{\prod_{k=0,1,2} a[k]}{a[1]\cdot\prod_{k=0,2}(a[k]-a[1])}$$

RIGHT NOZZLE:

$$p[2]=\frac{\prod_{k=0,1,2} a[k]}{a[2]\cdot\prod_{k=0,1}(a[k]-a[2])}$$

p[1] ← p[1]−1

(III) IRREGULARITY CORRECTION COEFFICIENT
ADD THE CORRECTION COEFFICIENT (p[3]) WITHIN THE CORRECTION WINDOW TO (coef[nzl]).

(B) WHEN THE CENTER NOZZLE IS MISFIRING

(I) ADD THE IDEAL POSITION INTERVAL VALUE L TO THE POSITION ERROR (err_xx) OF EACH NOZZLE (LEFT: −L, CENTER: 0, RIGHT: +L) AND CONVERT THE VALUE TO AN ABSOLUTE VALUE (a[3]).

(II) CALCULATE THE CORRECTION COEFFICIENT (p[3]) USING THE POSITION ERROR INFORMATION (a[3]).
(CALCULATE AS IF THERE IS NO MISFIRING CENTER NOZZLE)

LEFT NOZZLE:

$$p[0]=\frac{\prod_{k=0,2} a[k]}{a[0]\cdot\prod_{k=2}(a[k]-a[0])}$$

RIGHT NOZZLE:

$$p[2]=\frac{\prod_{k=0,2} a[k]}{a[2]\cdot\prod_{k=0}(a[k]-a[2])}$$

p[1] ← −1

(III) IRREGULARITY CORRECTION COEFFICIENT
ADD THE CORRECTION COEFFICIENT (p[3]) WITHIN THE CORRECTION WINDOW TO (coef[nzl]).

(C) WHEN THE LEFT OR RIGHT NOZZLE IS MISFIRING

(I) ADD THE IDEAL POSITION INTERVAL VALUE L TO THE POSITION ERROR (err_xx) OF EACH NOZZLE (LEFT: −L, CENTER: 0, RIGHT: +L) AND CONVERT THE VALUE TO AN ABSOLUTE VALUE (a[3]).

(II) CALCULATE THE CORRECTION COEFFICIENT (p[3]) USING THE POSITION ERROR INFORMATION (a[3]).
(CALCULATE AS IF THERE IS NO LEFT MISFIRING NOZZLE OR RIGHT MISFIRING NOZZLE.)

WHEN THE LEFT NOZZLE IS MISFIRING:
CENTER NOZZLE:

$$p[1]=\frac{\prod_{k=1,2} a[k]}{a[1]\cdot\prod_{k=2}(a[k]-a[1])}$$

RIGHT NOZZLE:

$$p[2]=\frac{\prod_{k=1,2} a[k]}{a[2]\cdot\prod_{k=1}(a[k]-a[2])}$$

p[0] ← 0
p[1] ← p[1]−1

WHEN THE RIGHT NOZZLE IS MISFIRING: OMISSION (III) IRREGULARITY CORRECTION COEFFICIENT
ADD THE CORRECTION COEFFICIENT (p[3]) WITHIN THE CORRECTION WINDOW TO (coef[nzl]).

S140

MOVE THE VALUE OF THE IRREGULARITY COEFFICIENT (coef[j]) FOR EACH PIXEL DENSITY TO THE DENSITY-SPECIFIC IRREGULARITY CORRECTION COEFFICIENT (COEF[d][j]), MISFIRING LEFT NOZZLE CORRECTION COEFFICIENT (L_COEF[d][j]), AND MISFIRING RIGHT NOZZLE CORRECTION COEFFICIENT (R_COEF[d][j]). (AT THIS TIME, ADD 1 TO THE CORRECTION VALUE.)

WHEN j = 0 TO Nnzl → j = nzl−1: R_COEF[d][nzl] = coef[nzl−1]+1
WHEN j = nzl+1: L_COEF[d][nzl] = coef [nzl+1]+1
WHEN j = nzl: DO NOT MOVE
WHEN j ≠ nzl−1, nzl, nzl+1: COEF[d][j] = coef[j]+1

END

PARTITION CONSTANT (Floyd)

| | | |
|---|---|---|
| | X | 7/16 |
| 3/16 | 5/16 | 1/16 |

y
x
INITIALIZATION:
0
0
0

IMAGE RECORDING DEVICE AND IMAGE RECORDING METHOD

The entire contents of literature cited in this specification are incorporated herein by reference.

BACKGROUND OF THE INVENTION

The present invention relates to the field of inkjet recording for forming an image on a recording medium by means of an inkjet recording method, and more specifically to an image recording device and image recording method for correcting the density non-uniformity that occurs due to the recording characteristics of a recording element and recording an image.

One method for recording an image on a recording medium is to discharge ink drops from an inkjet head so as to form an image.

In this inkjet recording method, ink drops are discharged from a plurality of ink discharge ports, resulting in the problem of density non-uniformity of the recorded image caused by the recording characteristics (depositing position errors, variance in the volume of supplied ink, etc.) of each recording element having an ink discharge port. This problem is particularly problematic when using a single pass inkjet method that fixes a line-type inkjet head so that it is stationary and feeds a recording medium in one direction once so as to record an image on the entire surface of the recording medium.

Methods for correcting this density non-uniformity include a method of changing discharge drive conditions in accordance with density non-uniformity and adjusting the dot diameter and dot density on each recording element, and a method of correcting image data in accordance with density non-uniformity so as to ensure that the image to be recorded will not be affected by the density non-uniformity.

The method of changing discharge drive conditions involves changing the ink drops discharged from the inkjet head, resulting in limitations on the inkjet head drive system and degree of correction at the time of implementation. Conversely, the method of correcting image data in accordance with density non-uniformity involves correcting the image data while leaving the ink drops actually discharged from the inkjet head as is, i.e., without changing the inkjet head itself (that is, without making any physical changes) This latter system results in the advantage of high flexibility.

Additionally, JP2942048 discloses an image forming device that forms an image by moving a recording head, which has a plurality of recording elements, and a recording medium relatively to each other in a direction differing from the disposed direction of the recording head, the image forming device comprising: first correcting means configured to selectively provide instructions on the recording characteristics of each element of the recording head to each of a plurality of density regions; second correcting means configured to correct a density signal based on the recording characteristics instructed by the first correcting means; and selecting means configured to select the recording characteristics to be instructed by the first correcting means in accordance with the density region affiliated with the density signal corresponding to each recording element.

SUMMARY OF THE INVENTION

As described in JP2942048, density correction curves (recording characteristics) common to recording elements each having the same characteristics and a correction table (selecting means) indicating the correspondence between each recording element and density correction curve are provided so that the density correction curve is determined by the correction table, thereby making it possible to reduce the amount of data and amount of calculations performed to less than that in a case where a density correction curve is provided for each recording element.

Here, with the inkjet recording method, there are cases of a misfiring nozzle, i.e., a nozzle that no longer discharges ink drops, taking place. When such a misfiring nozzle occurs, a misfiring correction coefficient for adjusting the volume of ink discharged from a nozzle near the misfiring nozzle is calculated to adjust the drops discharged from that nozzle, thereby alleviating the effect of the misfiring nozzle.

Such a misfiring nozzle occurs suddenly due to clogging or the like, and may be brought back to a normal ejecting condition by maintenance or with the passing of time. As a result, the misfiring correction coefficient that adjusts the volume of ink discharged from a nozzle near the misfiring nozzle needs to be calculated each time a misfiring state is detected and each time a misfiring state is resolved.

Nevertheless, the misfiring correction coefficient needs to be calculated with high precision for each image density in order to further reduce the effect of the misfiring nozzle, resulting in a problematic increase in the amount of calculations performed and a significant amount of time required for calculation. When a significant amount of time is required for calculation, a significant amount of time is required for image recording to begin after the misfiring nozzle information has been acquired. As a result, improvement in image recording efficiency is no longer possible.

It is therefore an object of the present invention to resolve the above problems that are based on prior art, and provide an image recording device and image recording method capable of quick response and efficient image recording, even in cases where a misfiring nozzle occurs.

An image recording device according to the present invention comprises:

a recording head that has a plurality of recording elements configured to discharge ink drops;

transport means that causes the recording head and the recording medium to move relatively to each other by transporting at least one of the recording head and the recording medium;

non-uniformity information acquiring means that acquires non-uniformity information of each recording element by using a test pattern;

non-uniformity correction coefficient calculating means that calculates a non-uniformity correction coefficient value for each density based on the non-uniformity information of each recording element acquired by the non-uniformity information acquiring means as recording characteristics of the recording element;

misfiring correction coefficient calculating means that calculates a misfiring correction coefficient value for each density in a case where a nearby recording element is misfiring based on the non-uniformity information of each recording element acquired by the non-uniformity information acquiring means as the recording characteristics of the recording element;

misfiring information detecting means that detects misfiring information of the recording elements;

selecting means that selects one of the recording characteristics calculated by the non-uniformity correction coefficient calculating means and the misfiring correction coefficient calculating means for each recording element based on pixel density data of image data and the misfiring information detected by the misfiring information detecting means;

correction processing means that corrects the pixel density data using the recording characteristics selected by the selecting means; and drive control means that drives the recording element based on the image data including the pixel density data corrected by the correction processing means.

An image recording method according to the present invention comprises the steps of:

acquiring non-uniformity information of each recording element by using a test pattern;

calculating a non-uniformity correction coefficient value for each density based on the acquired non-uniformity information of each recording element as recording characteristics of the recording element;

calculating a misfiring correction coefficient value for each density in a case where a nearby recording element is misfiring based on the acquired non-uniformity information of each recording element as the recording characteristics of the recording element;

detecting misfiring information of the recording elements;

selecting one of the calculated recording characteristics for each recording element based on pixel density data of image data and the detected misfiring information;

correcting the pixel density data using the selected recording characteristics; and driving the recording element based on the image data including the corrected pixel density data.

BRIEF DESCRIPTION OF THE DRAWINGS

FIGS. 8 and 9 are flowcharts illustrating a calculation example of density correction and the misfiring correction coefficient.

DETAILED DESCRIPTION OF THE INVENTION

The image recording device and image recording method according to the present invention will now be described based on the embodiments illustrated in accompanying drawings.

Figure 1:
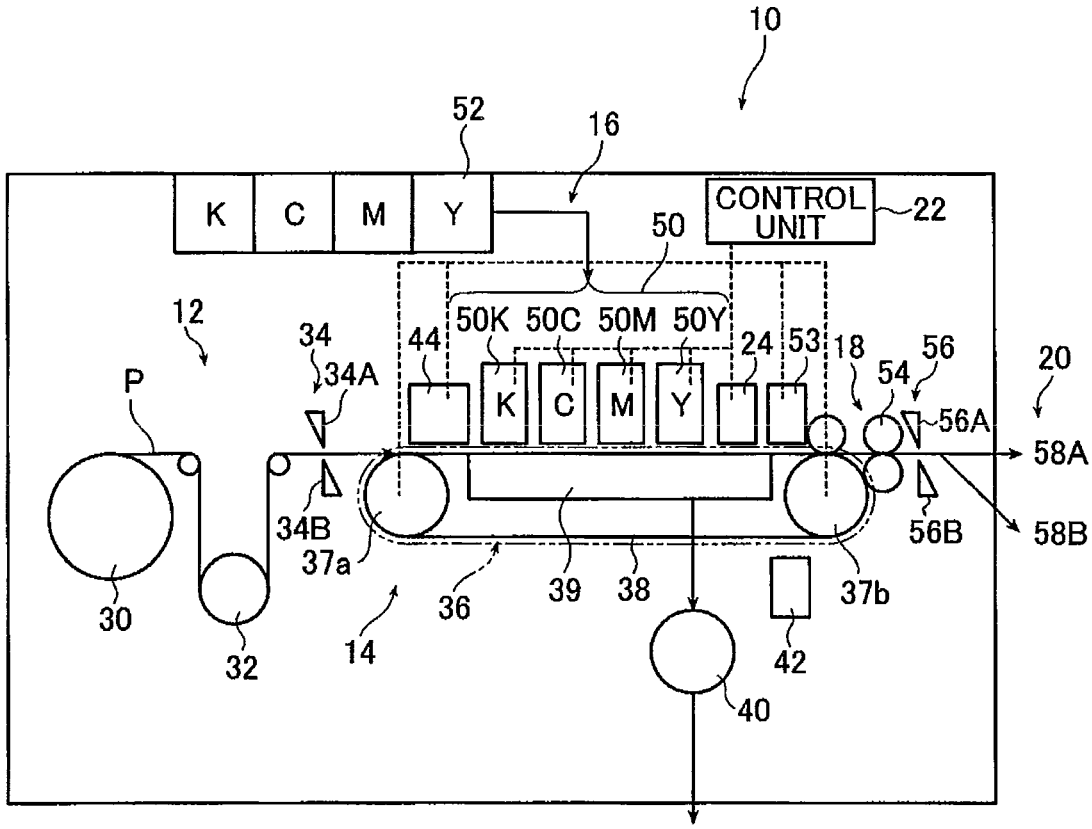
FIG. 1 is a front view schematically illustrating the configuration of an image recording device.
Figure 2:
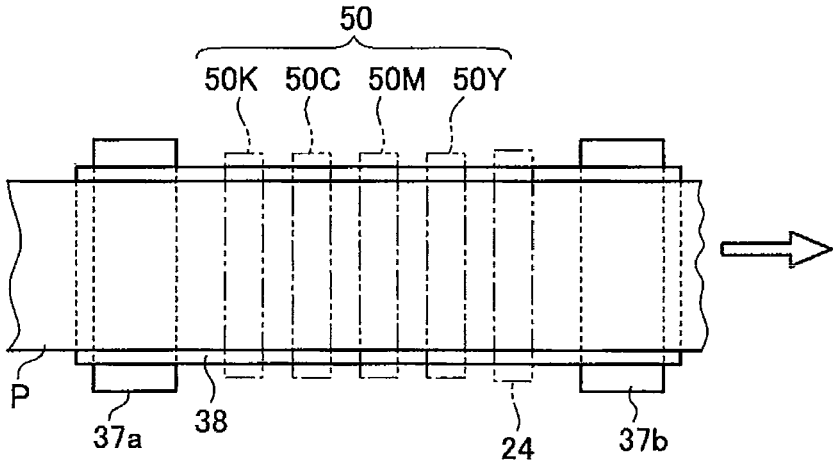
FIG. 2 is a top view illustrating a suction transport belt and a recording head unit of the image recording device illustrated in FIG. 1.

FIG. 1 is a front view schematically illustrating the configuration of an image recording device 10 of an embodiment of an image recording device of the present invention, and FIG. 2 is a top view illustrating a suction belt transport unit 36 and a recording head unit 50 of the image recording device 10 of FIG. 1.

An image recording device 10 basically comprises a feed assembly 12 for feeding a recording medium P, a transport assembly 14 for transporting the recording medium P fed from the feed assembly 12 with the recording medium P kept flat, a drawing assembly 16 including the recording head unit 50 disposed opposite the transport assembly 14 to draw an image on the recording medium P and an ink reservoir/filler unit 52 for storing ink fed to the recording head unit 50, a heating/pressing assembly 18 for heating and pressing the recording medium P on which an image has been drawn, a discharge assembly 20 for discharging to the outside the recording medium P bearing the image, a scanner 24 for reading the image recorded on the recording medium P by the drawing assembly 16, and a control unit 22 for controlling the above assemblies.

The feed assembly 12 comprises a magazine 30, a heating drum 32, and a cutter 34.

The magazine 30 contains a roll of the recording medium P. When an image is drawn, the recording medium P is fed from the magazine 30 to the heating drum 32.

The heating drum 32 is disposed downstream of the magazine 30 on the transport path of the recording medium P to heat the recording medium P fed from the magazine 30, with the recording medium P bent in a reverse direction to that in which it was stored in the magazine 30.

The heating drum 32 heats the recording medium P to remove the curly shape of the recording medium P assumed when it was stored in the magazine 30. Thus, the heating drum 32 decurls the recording medium P.

Preferably, the heating temperature is controlled so that the printing surface slightly curls outwards.

The cutter 34 comprises a fixed blade 34A having a length greater than the width of the transport path for the recording medium P and a round blade 34B that moves along the fixed blade 34A. The round blade 34B is disposed on the side of the recording medium P on which an image is to be recorded; the fixed blade 34A is disposed on the opposite side of the transport path from the round blade 34B.

The cutter 34 cuts the heating drum P fed through the heating drum 32 to a desired size.

Here, a magazine is shown as the supply assembly in the present embodiment, but the present invention is not limited thereto and more magazines that house recording mediums having differences such as paper width, quality, and type may be jointly provided. Moreover, cassettes that are loaded in layers with the recording medium cut at a predetermined length may be used jointly or in lieu of the magazine. When using only a recording medium P previously cut to a predetermined length as the recording medium P, the heating roller and the cutter described above need not necessarily be provided.

When using a plurality of magazines and/or cassettes with a configuration where two or more kinds of recording paper can be used, it is preferable that an information recording unit such as bar code and wireless tag where information including, for example, the kind of paper is recorded is attached to the magazines and/or cassettes so that a reader can read out information recorded in the information recording unit to allow automatic recognition of the kind of paper used and perform ink discharge control to achieve an appropriate ink discharge according to the kind of paper.

The transport assembly 14 comprises the suction belt transport unit 36, a suction chamber 39, a fan 40, a belt cleaner 42, and a heating fan 44, and transports the recording medium P decurled and cut to a predetermined length by the supply assembly 12 to a drawing position, i.e., to a position where image drawing is performed by the drawing assembly 16 described later.

The suction belt transport unit 36 is disposed on the transport path of the recording medium P, on the downstream side of the cutter 34, and comprises a roller 37*a*, a roller 37*b*, and a belt 38.

The belt 38 is an endless belt having a width greater than that of the recording medium P and passed over the roller 37*a* and the roller 37*b*. The belt 38 has numerous suction pores (not shown) formed in its surface.

At least the image drawing (printing) position of the suction belt transport unit 36, i.e., the section opposite the nozzle surface of the recording head unit 50 (described later) of the drawing assembly 16, and the image detection position, i.e., the section opposite the sensor surface of the scanner 24 described later, are held horizontal (flat) against the nozzle surface and sensor surface.

At least one of the rollers 37*a* and 37*b* around which the belt 38 is wound is connected to a motor (not shown), and the motor power is transmitted to the belt 38 via at least one of the rollers 37*a* and 37*b*, thereby driving the belt 38 in the clockwise direction in FIG. 1, and transporting the recording medium P held by the belt 38 from the left to the right in FIG. 1.

The means for transporting the recording medium P is not limited specifically; a roller nip transport mechanism may be used in place of the suction belt transport unit 36. Because the roller nip transport is liable to cause the image to feather as the roller touches the printing surface of the paper immediately after printing in the drawing region, the suction belt transport as in the embodiment under discussion is preferable whereby the image surface is not touched by the belt when passing through the drawing region.

The suction chamber 39 is provided on the inside of the belt 38 and opposite the nozzle faces of the recording head unit 50 to be described of the drawing assembly 16 and the sensor face of the scanner 24. The fan 40 is connected to the suction chamber 39. The suction chamber 39 is sucked by the fan 40 to produce a negative pressure therein and hold the recording medium P onto the belt 38 by suction.

The recording medium P, sucked onto the belt, can be held firmly.

The belt cleaner 42 is disposed on the outside of the belt 38 so as to face the outer surface of the annular belt 38 and located off the transport path for the recording medium P. Accordingly, the belt 38 passes through the drawing assembly 16, discharges the recording medium P to pressure rollers 54 to be described and then passes a position opposite the belt cleaner 42.

The belt cleaner 42 removes ink that has stuck to the belt 38 after printing, for example, borderless photographs. The belt cleaner 42 used may be, for example, a system in which the belt is nipped with rollers such as a brush roller and a water absorbent roller, an air blow system in which clean air is blown onto the belt, or a combination of these. When a method using nipped cleaner rolls is employed, high cleaning effects are produced by giving the belt a different linear velocity from that of the rolls.

The heating fan 44 is disposed on the outside of the belt 38 and upstream of the recording head unit 50 to be described of the drawing assembly 16 on the transport path for the recording medium P.

The heating fan 44 blows hot air onto the recording medium P before drawing to heat the recording medium P. Heating the recording medium P before drawing makes it easier for ink to dry after landing thereon.

The drawing assembly 16 comprises the recording head unit 50 for recording (printing) an image and the ink reservoir/filler unit 52 for supplying ink to the recording head unit 50.

The recording head unit 50 comprises the recording heads 50K, 50C, 50M, and 50Y and is located opposite a plane on which the recording medium P is placed.

The recording heads 50K, 50C, 50M, and 50Y are piezo inkjet heads which respectively discharge ink of the colors black (K), cyan (C), magenta (M), and yellow (Y) from the discharge units, and are disposed opposite the surface of the belt 38 on which the recording medium P is positioned, downstream in the transport direction of the recording medium P from the heating fan 44, near the heating fan 44, in the order of the recording heads 50K, 50C, 50M, and 50Y, the recording head 50K being the closest to the heating fan 44. The recording heads 50K, 50C, 50M, and 50Y are connected to an ink reservoir/filler unit 52 and the control unit 22.

The recording heads 50K, 50C, 50M, and 50Y are full-line type ink jet heads having discharge units (nozzles) disposed in arrays in the areas exceeding a maximum width of the recording medium P in the direction normal to the recording medium transport direction as illustrated in FIG. 2. The configuration of the ink jet heads will be described later in detail including its relationship with the ink reservoir/filler unit 52.

Use of a full-line type recording heads as in the embodiment under discussion enables an image to be recorded on the whole surface of the recording medium P by moving the recording medium P and the drawing unit 16 once relative to each other (i.e., in one scan) in the direction (i.e., auxiliary scan direction) normal to the direction in which the recording heads and the discharge units extend. Thus, the full-line type heads are capable of rapid printing and hence increase productivity as compared with the shuttle type heads wherein the recording heads reciprocate in the main scan direction.

The ink reservoir/filler unit 52 comprises ink supply tanks for storing inks each having colors corresponding to the recording heads 50K, 50C, 50M, and 50Y, respectively.

Each ink supply tank may, for example, be of a type whereby the tank is refilled with ink from an inlet (not shown) when the ink is running short or of a cartridge type whereby the whole tank is replaced.

The ink supply tanks of the ink reservoir/filler unit 52 are connected through conduit lines, not shown, to the recording heads 50K, 50C, 50M, and 50Y, respectively, to supply the recording heads 50K, 50C, 50M, and 50Y with inks.

Preferably, the ink reservoir/filler unit 52 comprises alarm means (display means, alarm sounding means, etc.) that, when ink is running short, gives a notification to that effect and a mechanism for preventing refill with ink of a wrong color.

When different kinds of ink are employed according to use, the cartridge type is preferably used. Preferably, a bar code or the like is used to identify the kind of ink and thus achieve a discharge control that is specific to the kind of ink.

Now, the structures of the recording heads 50K, 50C, 50M, and 50Y will be described. Since the recording heads 50K, 50C, 50M, and 50Y share the same configuration except for the color of the discharged ink, the recording head 50K will be described below as a representative.

Figure 3A:
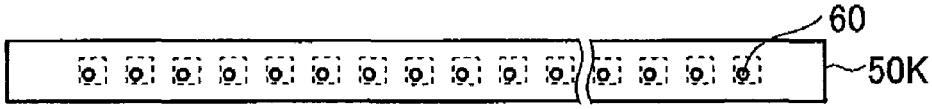
FIG. 3A is a front view illustrating the arrangement pattern of the discharge units of the recording head.
Figure 3B:
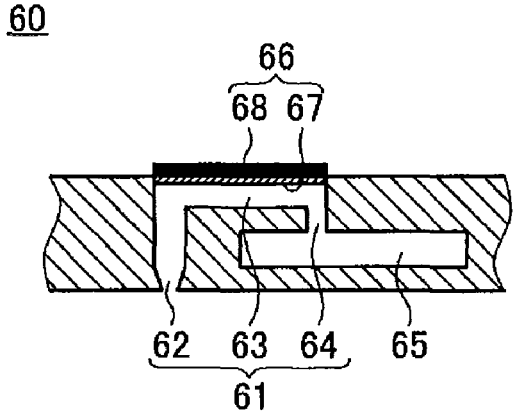
FIG. 3B is an enlarged cross-sectional view showing one discharge unit of the recording head of FIG. 3A.

FIG. 3A is a front view illustrating an arrangement pattern of the discharge units 60 of the recording head 50K; FIG. 3B is an enlarged cross-section of one of the discharge units 60.

As shown in FIG. 3A, the recording head 50K comprises a plurality of recording elements (hereinafter "discharge units") 60 configured to discharge ink drops. The discharge units 60 are arrayed at regular intervals.

As illustrated in FIG. 3B, one discharge unit 60 comprises an ink chamber unit 61 and an actuator 66. The ink chamber unit 61 is connected to a common flow channel 65. The common flow channel 65 is connected to the ink chamber units 61 of a plurality of discharge units 60.

Each ink chamber unit 61 comprises a nozzle 62, a pressure chamber 63, and a supply inlet 64.

The nozzle 62 is an opening through which ink drops are discharged, one end thereof being open opposite the recording medium P and the other end connected to the pressure chamber 63.

The pressure chamber 63 is a rectangular solid having a substantially square planar figure in a plane normal to the direction in which ink drops are discharged. Two diagonally positioned corners of the square are connected to the nozzle 62 and the supply inlet 64, respectively.

One end of the supply inlet 64 communicates with the pressure chamber 63 and the other end communicates with the common flow channel 65.

The actuator 66 is provided on the top side or the side opposite from the surface of the pressure chamber 63 through which the nozzle 62 and the supply inlet 64 are connected. The actuator 66 comprises a pressure plate 67 and an individual electrode 68.

When a drive voltage is applied to the individual electrode 68, the pressure plate 67 deforms.

Next, the method of discharging ink from the discharge unit 60 will be described.

Ink is fed from the common flow channel 65 through the supply inlet 64 to the pressure chamber 63 and the nozzle 62.

When the drive voltage is applied to the individual electrode 68, with the pressure chamber 63 and the nozzle 62 both filled with ink, the pressure plate 67 deforms to pressurize the pressure chamber 63, causing the nozzle 62 to discharge ink. Thus, activating the actuator 66 causes the nozzle 62 to discharge an ink drop.

Upon discharge of ink, fresh ink is fed to the pressure chamber 63 from the common flow channel 65 through the supply inlet 64.

The configuration of the discharge unit according to the invention is not limited specifically to the example illustrated in the drawings. Although the embodiment uses an ink discharge method whereby the actuator 66 as typified by a piezoelectric element is deformed to discharge ink drops, the invention is not limited to this; in place of the method using a piezoelectric element, one may use a thermal jet method whereby ink is dried by heating with a heat generator such as a heater to produce air bubbles, which in turn generate a pressure that causes ink drops to be released.

Now, the relationship between the recording head 50 and the ink reservoir/filler unit 52 will be described in greater detail.

Figure 4:
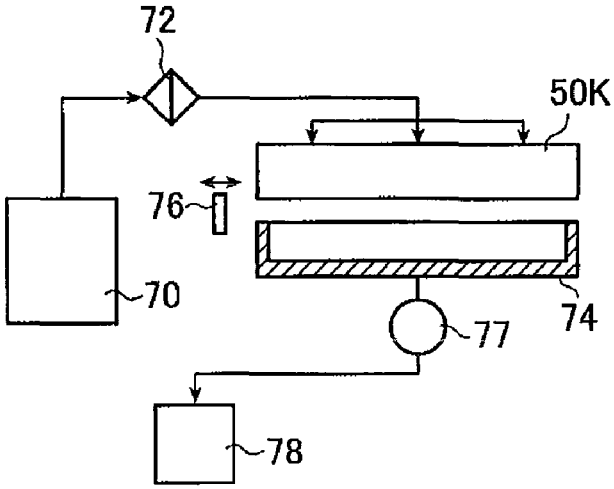
FIG. 4 is a schematic view illustrating the configuration of the peripherals of an ink supply system and the recording head of the image recording device.

FIG. 4 is a schematic view illustrating peripherals of an ink supply system and the recording head of the image recording device 10. The respective relationships between each of the recording heads 50K, 50C, 50M, and 50Y and the ink reservoir/filler unit 52 are same, excluding ink type. Thus, the following describes only the relationship between the recording head 50K and the ink reservoir/filter unit 52, and descriptions of the respective relationships between the recording heads 50C, 50M, 50Y, and the ink reservoir/filler unit 52 will be omitted.

An ink supply tank 70 is a tank for storing ink of a color corresponding to the recording head 50K, i.e., black ink and is disposed inside the ink reservoir/filler unit 52. The recording head 50K and the ink supply head 70 communicate through a supply duct.

A filter 72 is provided in the middle of a flow channel connecting the ink supply head 70 and the recording head 50K to remove foreign matter and air bubbles. The filter mesh size of the filter 72 is preferably equivalent to the nozzle diameter or less than or equal to the nozzle diameter (generally, about 20 μm).

Preferably, an auxiliary tank is provided close to or integrally with the recording head 50K. The auxiliary tank provides a damper effect to prevent the internal pressure of the head from changing, thus improving the refill operation.

As illustrated in FIG. 4, the image recording device 10 further comprises a cap 74 to prevent the nozzle 62 from drying or viscosity of ink close to the nozzle from increasing, a suction pump 77, a collecting tank 78, and a cleaning blade 76 for cleaning the nozzle faces of the recording head 50K, i.e., the surface in which the nozzles 62 each have an opening.

A maintenance unit comprising the cap 74 and the cleaning blade 76 permits relative movement with respect to the recording head 50K through a moving mechanism, which is not shown, so that it can be moved, when necessary, from a given retreat position to a maintenance position beneath the recording head 50K.

In the maintenance position, the cap 74 is located opposite the recording head 50K and so supported that it can be vertically moved by a lifting mechanism, which is not shown, with respect to the recording head 50K.

The cap 74 is lifted to a given position by the lifting mechanism not shown when the power is turned off or the recording device is in a printing standby mode to come into close contact with the recording head 50K and cover the nozzle faces of the recording head 50K.

Covering the nozzle faces of the recording head 50K with the cap 74 to place it in a sealed state prevents the ink in the nozzle from drying and hence sticking and further keeps ink solvent from evaporating, which would otherwise cause increased ink viscosity.

At the time of maintenance or periodically, the actuator 66 may be actuated with the cap 74 attached to the recording head 50K to cause the nozzle 62 to discharge ink.

When the recording head 50K is in a drawing or standby state and the specific frequency of use of the nozzle 62 decreases to the extent that the nozzle 62 does not discharge ink for a certain period of time or longer, the ink solvent near the nozzle may evaporate, increasing ink viscosity and making ink discharge from the nozzle 62 no longer possible. However, the deteriorated ink within the nozzle 52 (the ink near the nozzle that has increased viscosity) can be discharged from within the nozzle 62 by pre-discharging (purging, bleeding, spitting) ink into the cap 74. This prevents ink clogs in the nozzles 62 and prevents variation in ink viscosity among the nozzles 62, which would otherwise cause variation in discharge characteristics among them. Thus, stable ink drop discharge can be ensured.

The pump 77 has one end thereof connected to the cap 74 and the other end to the collecting tank 78. Upon suction effected by the suction pump 77, with the cap 74 attached to the recording head 50K so the cap 74 and the recording head 50K are in close contact, the ink inside the nozzle 62 is sucked out. The ink sucked by the suction pump 77 is fed to the collecting tank 78.

Thus, even where the actuator 66 fails to cause a nozzle to discharge ink because of, for example, air bubbles entering the ink in a pressure chamber 63 of the recording head 50K, suction of ink by the suction pump 77 causes the ink inside the pressure chamber 63 (ink containing air bubbles mixed therein) to be removed. Thus, the recording head is restored to a state where it can discharge ink drops.

Preferably, suction by the suction pump 77 is performed also at the time of refill of fresh ink in the head or when use is resumed after a long-term disuse in order to suck out degraded ink of which the viscosity has increased (i.e., hardened ink).

Further, suction of ink, which is performed on the whole ink inside the pressure chamber 63, consumes a great amount of ink. Thus, in a case where the rise in ink viscosity is minimal, ink drops are preferably discharged (pre-discharged) into the cap 74 as described above.

The cleaning blade 76 is formed of an elastic material such as rubber. At the time of maintenance, it is disposed in contact with the nozzle surfaces of the recording head 50K. The cleaning blade 76 is connected to a blade moving mechanism (wiper), not shown, so that it is moved over the nozzle faces by the blade moving mechanism. The cleaning blade 76 wipes off ink drops and foreign matter adhered to the nozzle surfaces as it slides over the nozzle surfaces. Thus, the nozzle surfaces are cleaned.

Furthermore, when the dirt on the ink discharge surface is cleaned by the blade mechanism, pre-discharge is preferably performed to prevent foreign matter from entering the nozzle 62 by means of the blade.

Returning back to FIG. 1, other components of the image recording device 10 will be described.

The heating/pressing assembly 18 comprises a post-drying unit 53 and a pair of pressure rollers 54 to heat/press the recording medium P bearing an image drawn by the drawing assembly 16 and dry to fix the image.

The post-drying unit 53 is disposed downstream of the recording head unit 50 and opposite the belt 38 on the transport path for the recording medium P. The post-drying unit 53 includes a heating fan or the like for blowing hot air onto the image bearing side of the recording medium P to dry the image that has been drawn.

Drying the ink on the recording medium representing the image using the heating fan enables drying without touching the image. This prevents occurrence of image defects or smears in the image drawn on the recording medium P.

The pair of pressure rollers 54 are disposed downstream of the post-drying unit 53 on the transport path for the recording medium P. The pair of pressure rollers 54 nip and transport the recording medium P that passed the post-drying unit 53 and parted from the belt 38.

The pair of pressure rollers 54 are means for controlling the glossiness of the image surface. The image surface of the recording medium P transported by the suction belt transport unit 36 is heated and pressed at the same time by the pressure rollers 54 having a surface provided with a given relief pattern to transfer the relief pattern onto the image surface.

When dye-based ink is used for printing on porous paper, for example, applying pressure causes the pores of the paper to close, which prevents contact with substances such as ozone that can be a cause to destroy the dye molecules and thus provides the image with an enhanced weather resistance.

The image recording device 10 has a cutter (second cutter) 56 disposed downstream of the heating/pressing assembly 18 on the transport path of the recording medium P.

The cutter 56 is composed of a fixed blade 56A and a round blade 56B and provided to cut off a normal image part from an image part for misalignment detection when the recording medium P is printed with both.

The discharge assembly 20 comprises a first discharge unit 58A and a second discharge unit 58B and is provided downstream of the cutter 56 on the transport path for the recording medium P. The discharge assembly 20 discharges the recording medium P bearing the image that has been fixed by the heating/pressing assembly 18.

Here, in the present embodiment, selecting means (not shown) switches the discharge assembly that discharges the recording medium P so that a recording medium on which a regular image is drawn is discharged in the first discharge unit 58A, and a recording medium on which an image used for position variance detection or an unnecessary recording medium is discharged in the second discharge unit 58B.

Preferably, the discharge assembly 20 comprises a sorter for collecting the recording mediums according to orders placed.

Although it is preferable to provide two discharge units to permit selection of an discharge unit according to use, the invention is not limited to this embodiment. Only one discharge unit may be provided, for example, so that all the recording media is discharged through one discharge unit. Alternatively, three discharge units may be provided.

The control unit 22 controls the transporting, heating, drawing, and image detection of the recording medium P performed by the supply assembly 12, the transport assembly 14, the drawing assembly 16, the heating/pressing assembly 18, the ejecting assembly 20, and the scanner 24. The configuration of the control unit 22 will be described later in detail.

The scanner 24 is disposed opposite the outside (outer peripheral surface) of the belt 38 and between the recording head unit 50 and the post-drying unit 53. The scanner 24 comprises image sensors (e.g., line sensors) for imaging (i.e., reading) a test pattern formed by the drawing assembly 16. The image sensor reads an image recorded on the recording medium. The scanner 24 is capable of reading an image with a resolution that is selectable from at least two different resolutions according to a mode.

The scanner 24 according to this embodiment comprises line sensors having arrays of photoreceptors each wider than the ink discharge width of the recording heads 50K, 50C, 50M, and 50Y (image recording width). The line sensor is a color separation line CCD sensor comprising arrays of an R sensor, a G sensor, and a B sensor such that the R sensor is a line of photo-electric transducers (pixels) provided with red color filters, the G sensor is a line of photo-electric transducers (pixels) provided with green color filters, and the B sensor is a line of photo-electric transducers (pixels) provided with blue color filters. The line sensor may be replaced by an area sensor having photoreceptors arranged two-dimensionally.

Figure 5:
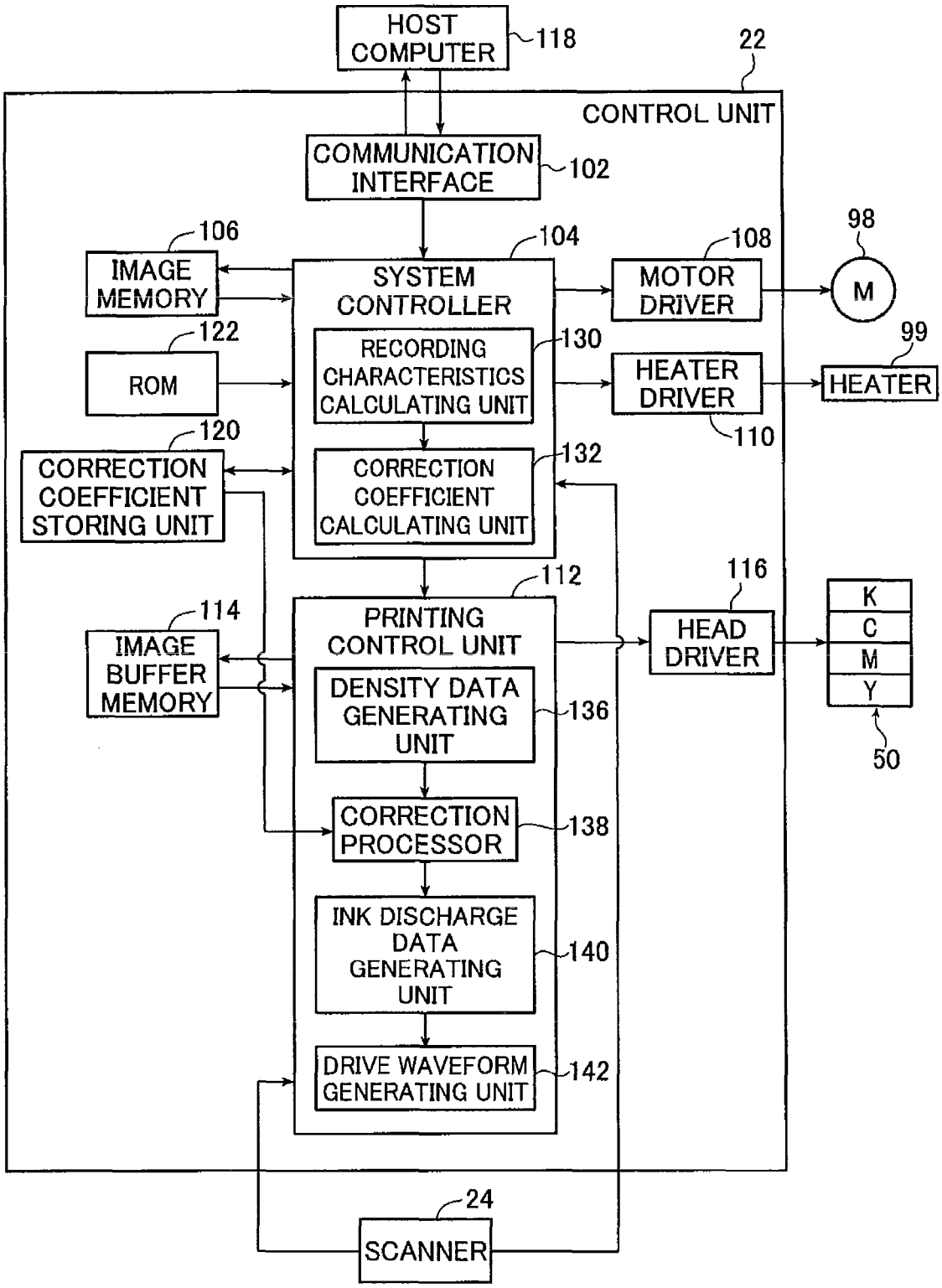
FIG. 5 is a block diagram illustrating the major components of the system configuration of the control unit of FIG. 1.

FIG. 5 is a block diagram illustrating major components of a system configuration of the control unit 22 of the image recording device 10.

The control unit 22 comprises a communication interface 102, a system controller 104, an image memory 106, a motor driver 108, a heater driver 110, a printing controller 112, an image buffer memory 114, and a head driver 116, and controls the transporting, heating, drawing, and detection of position variance of the recording medium P performed by the supply assembly 12, the transport assembly 14, the drawing assembly 16, the heating/pressing assembly 18, the discharge assembly 20, and the scanner 24, as described above.

The system controller 104 controls the communication interface 102, the image memory 106, the motor driver 108, the heater driver 110, among others. The system controller 104 comprises a central processing unit (CPU) and its peripheral circuits and controls communications with a host computer 118 and the read and write in the image memory 106 and some other operations. The system controller 104 generates a control signal for controlling the motor 98 in the transport system and the heater 99.

The system controller 104 comprises a recording characteristics calculating unit 130 configured to generate recording characteristics data for each discharge unit, including depositing position error and drop diameter data from the scanned data of the test pattern read from the scanner 24, and a correction coefficient calculating unit 132 configured to calculate a non-uniformity correction coefficient from the recording characteristics of each discharge unit and a correction coefficient in a case where a nozzle is misfiring. The recording characteristics calculation method used by the recording characteristics calculating unit 130, and the non-uniformity correction coefficient and misfiring correction coefficient calculation method used by the correction coefficient calculating unit 130 will be described later. The information processing performed by the recording characteristics calculating unit 130 and the correction coefficient calculation unit 132 is achieved by means of an ASIC (application specific integrated circuit), software, or a suitable combination thereof.

A correction coefficient storing unit 120 stores the data of the non-uniformity correction coefficient and the data of the misfiring correction coefficient calculated by the correction coefficient calculating unit 132, and sends the required data of the stored non-uniformity correction coefficient and misfiring correction coefficient data to the printing controller 112.

The format of the non-uniformity correction coefficient data and misfiring correction coefficient data is not particularly limited, and may be stored as a look-up table (LUT) or as equations.

The LUT is a reference table that stores the relationship between nozzles (discharge units), image densities, and non-uniformity correction coefficients. For example, an LUT stores corresponding non-uniformity correction coefficients using nozzles, image densities, reference numerals, etc., as keys.

The program executed by the CPU of the system controller 104 and the various types of data (including data of the test pattern for measuring the depositing position error) which are required for control procedures are stored in a ROM 122. The ROM 122 may be a non-rewritable memory or a rewritable memory like an EEPROM. By utilizing the storage region of this ROM 122, the ROM 122 can be configured to be able to serve also as the correction coefficient storing unit 120.

The communication interface 102 receives image data including pixel density data from the host computer 118 and sends it to the system controller 104. The communication interface 102 may be a serial interface such as USB, IEEE1394, Ethernet (trademark), and a wireless network or a parallel interface such as Centronics. Further, a buffer memory may be mounted to increase communication speed.

The image memory 106 is memory means for temporarily storing an image entered through the communication interface 102 and allows data read/write through the system controller 104. The image memory 106 need not necessarily be a memory composed of a semiconductor device; it may be a magnetic medium such as a hard disk.

The image data sent from the host computer 118 is loaded on the image recording device 10 through the communication interface 102 and stored in the image memory 106 through the system controller 104.

The motor driver 108 is a driver (drive circuit) for actuating the motor 98 according to the instructions given by the system controller 104.

The heater driver 110 is a driver that drives the heater 99 of a post-drying unit 53, for example, in accordance with the instructions from the system controller 104.

A printing controller 112 comprises a density data generating unit 136, a correction processor 138, an ink discharge data generating unit 140, and a drive waveform generating unit 142. The printing controller 112 performs processing such as the various processing for generating a signal for printing control from the image data in the image memory 106 and processing for density non-uniformity correction, and supplies a printing control signal (print data) generated from the image data to a head driver 116.

The printing controller 112 controls the discharge timing of the ink drops of a recording head 50 via the head driver 116, based on the image data that have been subjected to required signal processing. With this arrangement, the desired dot arrangement is achieved.

The density data generating unit 136 is signal processing means which generates the initial density data for the respective ink colors from the input image data, and performs pixel number conversion processing in a case where density conversion processing (including UCR processing and color conversion) is required.

The correction processor 138 is processing means which performs density correction calculations using the non-uniformity correction coefficient and misfiring correction coefficient stored in the correction coefficient storing unit 120, and carries out the density non-uniformity correction processing.

The ink discharge data generating unit 140 is signal processing means which includes half-toning processing means for converting the corrected density data generated by the correction processor 138 into binary (or multiple-value) dot data, and performs binary (or multiple-value) conversion processing. The ink discharge data generated by the ink discharge data generating unit 140 is supplied to the head driver 116, which controls the ink discharge operation of the head 50 accordingly.

The drive waveform generating unit 142 is means for generating drive signal waveforms in order to drive the actuators 66 corresponding to the respective nozzles 61 of the head 50. The signal (drive waveform) generated by the drive waveform generating unit 142 is supplied to the head driver 116. The signal generated by the drive signal generating unit 142 may be digital waveform data or an analog voltage signal.

The density data generating unit 136, the correction processor 138, the ink discharge data generating unit 140, and the drive waveform generating unit 142, which constitute signal processing means, process information by means of ASIC, software, or a suitable combination thereof.

The image buffer memory 114 temporarily stores image data, parameters, and other data when image data are processed in the printing controller 112. Although the image buffer memory 114 is attached to the printing controller 112 in FIG. 5, the image buffer memory 114 may also serve as the image memory 106. Further, the printing controller 112 and the system controller 104 may be combined to provide a single processor performing the functions of both units.

The head driver 116 drives the actuators corresponding to the discharge units of the recording heads 50K, 50C, 50M, and 50Y of each color, based on a discharge control signal (print data) supplied from the printing controller 112. The head driver 116 may include a feedback control system for keeping the head drive conditions constant.

Figure 6:
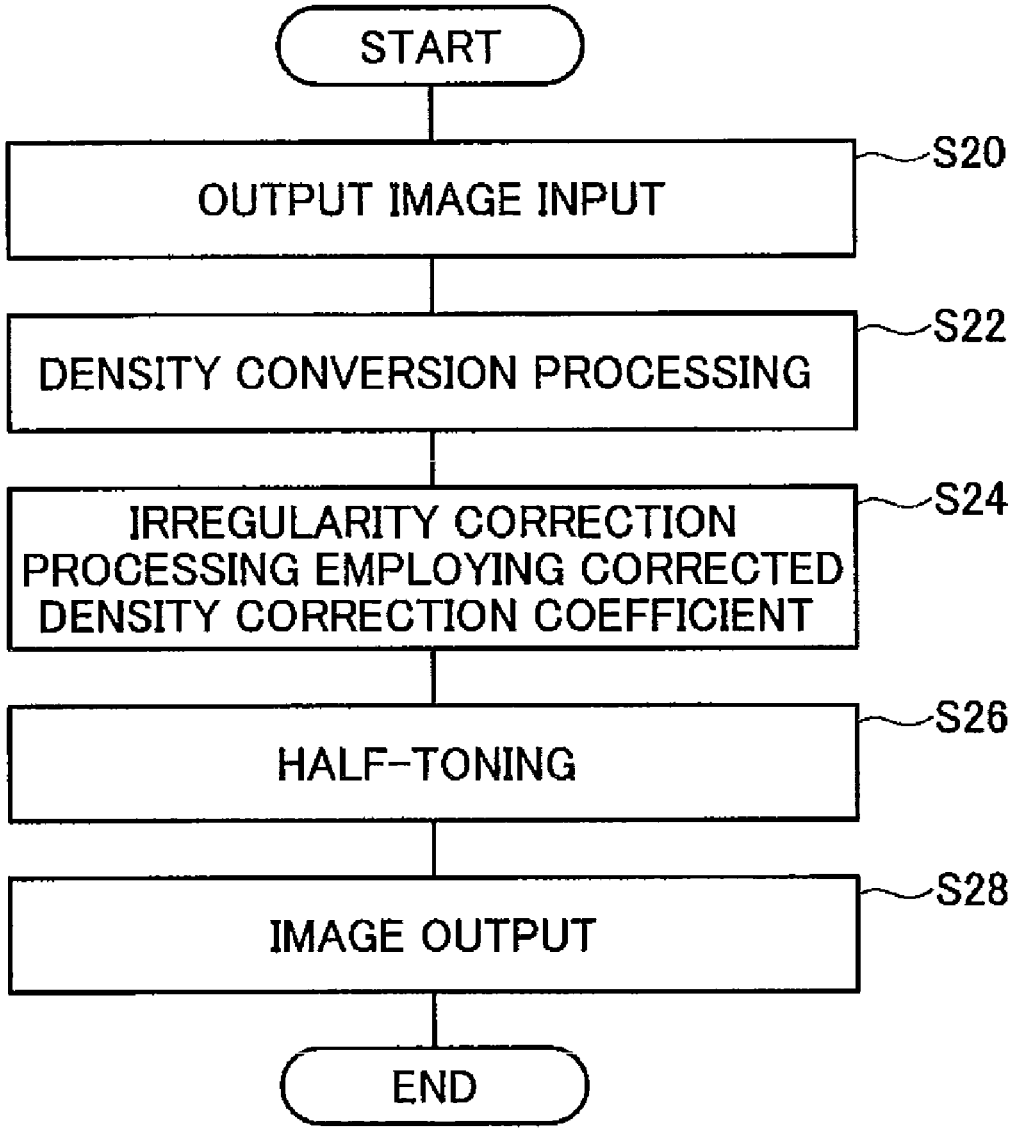
FIG. 6 is a flowchart illustrating each step of image recording.

FIG. 6 is a flowchart illustrating the procedure during image output.

The processing shown in the figure is executed by the control unit 22 each time an image is outputted.

When an image is to be outputted (printed), first the data of the image to be outputted (of the image to be printed) is inputted (step S20). There are no particular restrictions on the data format of the image at the time of input; for example, the data format is 24-bit color RGB data. Density conversion processing based on a look-up table is carried out on the input image data (step S22), thereby converting the input image into density data D (i, j) corresponding to the ink colors of the printer. Here, (i, j) indicates the position of a pixel, and hence the density data are assigned to each pixel. In this case, it is supposed that the resolution of the input image matches the resolution (nozzle resolution) of the printer for ease of explanation. If the resolution of the input image does not match the resolution of the printer, then pixel number conversion processing is carried out on the input image, in accordance with the resolution of the printer.

The density conversion processing in step S22 uses a general process, which includes under color removal (UCR) processing, light ink distribution processing in the case of a system which uses light ink (light-colored inks of the same color), and so on.

For example, in the case of the printer having a three-ink configuration comprising cyan (C), magenta (M), and yellow (Y), the image is converted into the CMY density data D (i, j). Alternatively, in the case of the printer having a system that includes other inks such as black (K), light cyan (LC), and light magenta (LM) in addition to the above three colors, then the image is converted into the density data D (i, j) including these additional ink colors.

Correction processing is carried out with respect to the density data D(i, j) obtained via the density conversion processing by the calculated non-uniformity correction coefficient and the misfiring correction coefficient (step S24). The detailed processing content of the non-uniformity correction coefficient and misfiring correction coefficient will be explained in FIG. 8 to FIG. 11. The corrected density data D' (i, j) is thus obtained.

Next, a half-toning process (screening) is applied to the corrected density data D' (i, j) (step S26), thereby converting the data into dot ON/OFF signals (in binary data), or alternatively, if the dot sizes are variable, then the data are converted into multiple-value data including dot types (dot size selection). There are no particular restrictions on the half-toning method used, and a commonly known binarizing (or multiple-value converting) method, such as error diffusion, dithering, or the like, may be used.

The ink drop discharge for each nozzle is based on the binary (or multiple-value) signals thus obtained, and the image is outputted (step S28). In other words, the ink discharge (drop discharge) data for each nozzle are generated on the basis of the binary (multiple-value) data obtained from the half-toning process (step S26), thereby controlling the discharge operation. With this arrangement, density non-uniformities are suppressed, making high-definition image formation possible.

Next, the method used by the image recording device 10 to create the non-uniformity correction coefficient and misfiring correction coefficient will be described. That is, the method used by a recording characteristics calculating unit 130 to detect recording characteristics, and the method used by a correction coefficient calculating unit 132 to calculate the non-uniformity correction coefficient and the misfiring correction coefficient will now be described.

Furthermore, the method for creating the non-uniformity correction coefficient and the misfiring correction coefficient is the same for the recording heads 50K, 50C, 50M, and 50Y, and therefore will be described below using the recording head 50K as a representative example.

First, to detect the recording characteristics of each discharge unit (recording element), a test pattern is drawn on the recording medium P using the recording head 50K.

Figure 7A:
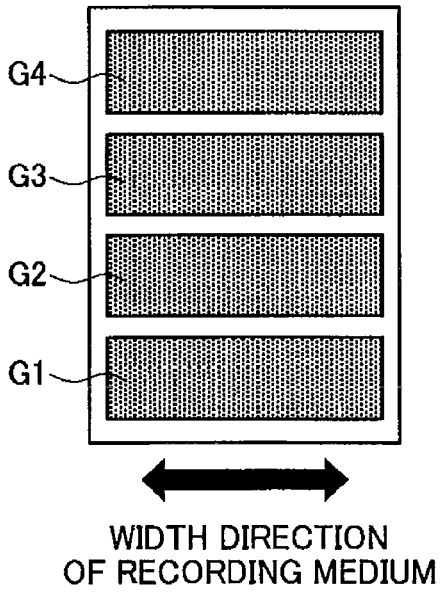
FIG. 7A is a schematic diagram illustrating an example of a test pattern.
Figure 7B:
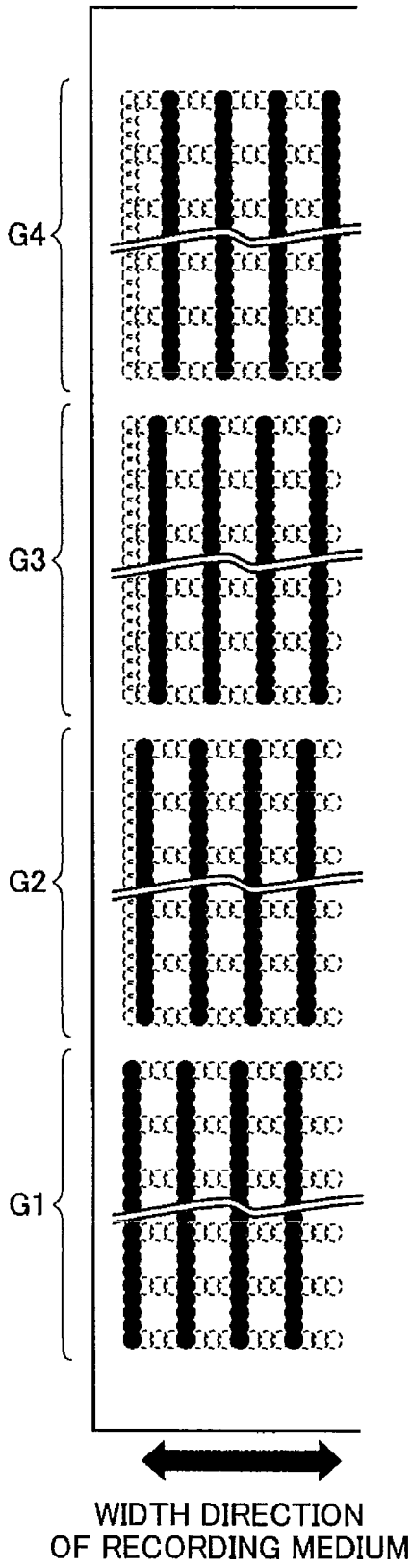
FIG. 7B is a partial enlarged view of FIG. 7A.

FIG. 7A is a schematic diagram illustrating an example of a test pattern, and FIG. 7B is a partial, enlarged view of FIG. 7A.

Specifically, when a plurality of discharge units disposed in a row as described above are defined as A1, A2, A3, . . . , An, in order from one end to the other, the discharge units are divided into the four groups of 4k−3, 4k−2, 4k−1, and 4k (where k=1, 2, 3, . . . ) based on the number of the discharge unit, ink drops are continually discharged from the discharge units having the discharge unit number 4k−3 so as to form a straight line per discharge unit on the recording medium P. Subsequently, ink drops are continually discharged from the discharge units having the discharge unit number 4k−2 so as to form a straight line per discharge unit on the recording medium P. And, subsequently, in the same manner, for both the discharge units having the discharge unit number 4k−1 and the discharge units having the discharge unit number 4k, a straight line is formed per discharge unit on the recording medium P.

Further, discharge units separated by a certain interval are grouped, making it possible to form a straight line without discharging ink from neighboring discharge units. With this arrangement, line overlap is prevented.

In the present embodiment, ink drops are discharged from each discharge unit of the recording head 50K while the transport assembly 14 transports the recording medium Pin the transport direction, i.e., the direction orthogonal to the recording heads 50K, thereby forming drop points on the recording medium.

In this manner, as shown in FIG. 7A and FIG. 7B, four groups (G1, G2, G3, and G4) are formed on the recording medium P in accordance with the four discharge unit groups, and a test pattern in which lines corresponding to the respective discharge units are formed is created for each group.

Furthermore, in the present embodiment, drop points of a plurality of types are formed by changing the number of drops dropped by each recording element at one drop point. Accordingly, a test pattern is created for each type of drop point as well. Furthermore, while all test patterns are recording on single recording medium, the test patterns may be recorded on a plurality of recording mediums. However, recording the test patterns on a single recording medium makes it possible to measure the recording characteristics described later with greater accuracy.

Next, the recording characteristics of each discharge unit are measured from the created test pattern.

First, a test pattern formed on the recording medium P is read.

Specifically, after a test pattern is formed, the recording medium P is further transported by the transport assembly 14 and passes through the position opposite the scanner 24.

The scanner 24 reads the test pattern by reading the image formed on the recording medium P that passes through the opposing position. The scanner 24 sends the read image data to the recording characteristics calculating unit 130 of the control unit 22.

Next, the recording characteristics calculating unit 130 calculates the recording characteristics (depositing position in this embodiment) of each discharge unit based on the test pattern.

Specifically, the recording characteristics calculating unit 130 calculates the depositing position of the ink drop of each discharge unit from the image data obtained from scanning the test pattern in which a line was formed per discharge unit.

Here, as described in JP 2006-264069 A, for example, the depositing position of the ink drop discharged from each discharge unit may be calculated by detecting a density profile of each line and calculating the center of each line from the detection results.

The method for calculating the center position is not particularly limited, and may be achieved by detecting both ends of the ink drops and establishing the middle point as the center, or by establishing the position with the highest density as the center.

Further, the depositing position is preferably calculated by calculating the center using the plurality of points of each line and connecting each center so as to calculate an approximate line. Connecting the centers of a plurality of points so as to calculate an approximate line makes it possible to more accurately detect the depositing position of the ink drop.

Further, the relative positional relationship between each group can also be accurately detected by extending the approximate line. The relative positional relationship is best formed by establishing a reference discharge unit when creating a test pattern and ensuring that the line formed by that discharge unit is formed by all four groups.

The difference (depositing position error) from the ideal depositing position of a drop point (depositing position of a presumed drop point) is calculated based on the depositing position of a drop point calculated in this manner.

Next, an example of the calculation of the non-uniformity correction coefficient and the misfiring correction coefficient will be described.

Figure 8:
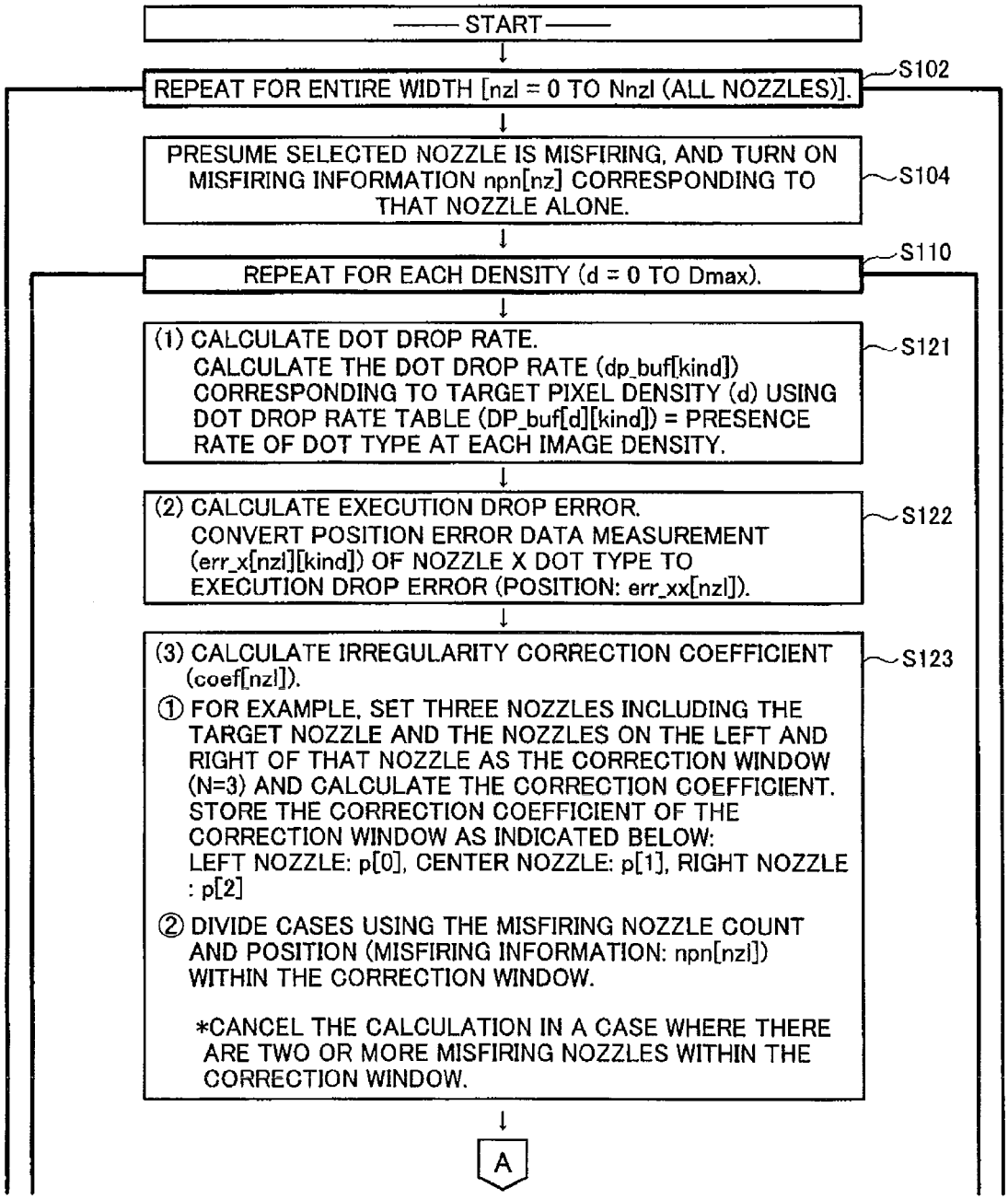

FIGS. 8 and 9 are flowcharts illustrating a calculation example of the non-uniformity correction coefficient and the misfiring correction coefficient. Here, an example of calculating the correction coefficients (non-uniformity correction coefficient and misfiring correction coefficient) corresponding to each pixel density in order to find the correction coefficients specific to each density will be described.

First, in the flowchart described below, the processing for calculating the non-uniformity correction coefficient and misfiring correction coefficient (step S102) is repeated for all widths, i.e., all nozzles (nzl=0 to N).

First, the selected nozzle (nozzle having nozzle number nzl) is presumed as misfiring, and the misfiring information corresponding to that nozzle alone is turned ON (step S104). That is, misfiring information that is based on the assumption that the selected nozzle is misfiring is created.

Here, in the flowchart described below, the processing for calculating the correction coefficient for each density at a predetermined interval size (at an interval of "0.5" for example) is repeated within the pixel density range of "0.0 to 1.0" (step S110).

For calculation target density (d), first the dot drop rate is calculated (step S121).

That is, a dot drop rate table that indicates the presense rate of the dot type at each image density is used to calculate the dot drop rate (dp_buf[kind]) corresponding to the target pixel density (d). The dot drop rate table (DP_buf[d] [kind]) is a table that sets density [d] and dot type [kind] as variables.

Figure 10:
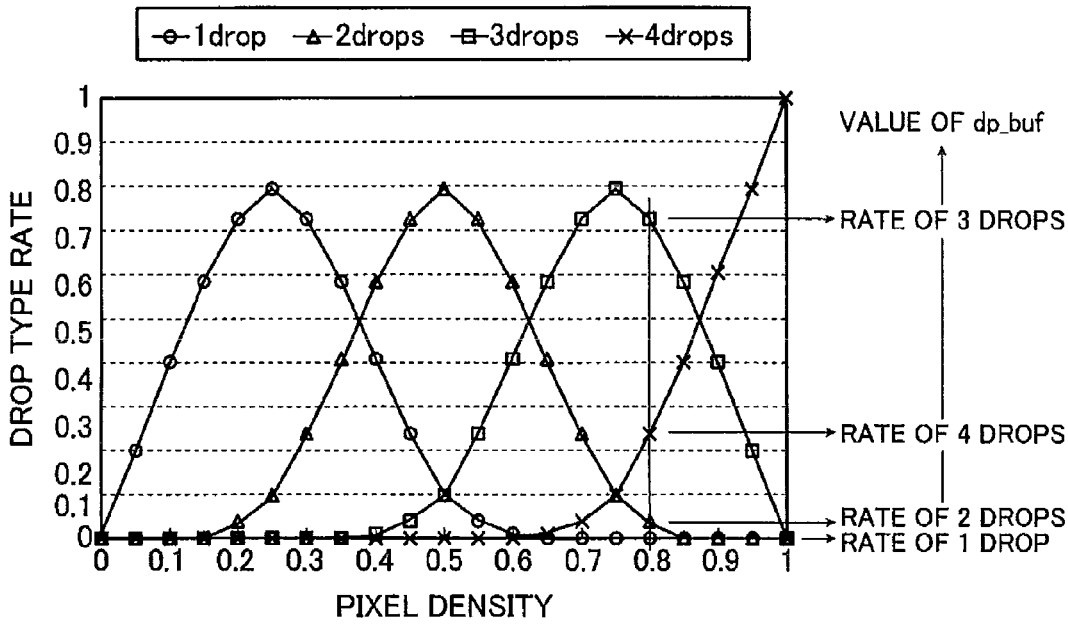
FIG. 10 is a graph illustrating the relationship between image density and the dot drop rate.

FIG. 10 illustrates an example of a dot drop rate table (DP_buf[d] [kind]). FIG. 10 illustrates an example of a case where there are four dot types (kind=[1, 2, 3, 4]). In the figure, the horizontal axis indicates pixel density, and the vertical axis indicates drop type (dot type) rate. For example, when the rate of each drop type in a case where pixel density=0.8 is observed, the rate of "3 drops" is highest at about 0.72, followed by the rate of "4 drops" at about 0.24, the rate of "2 drops" at about 0.04, and the rate of "1 drop" at about 0.0. In this manner, the rate of each drop type of a certain pixel density value is set as the value of dp_buf.

Figure 11:
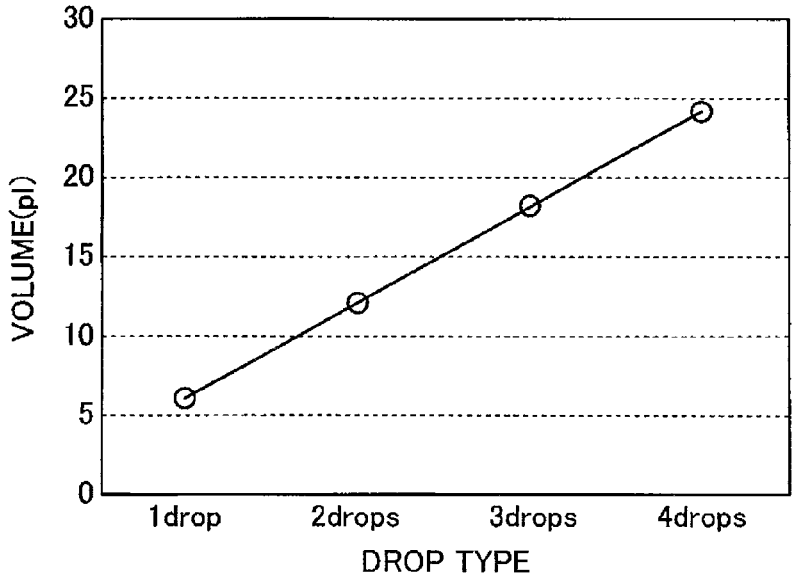
FIG. 11 is a graph illustrating the relationship between drop type and ink volume.

A related dot drop rate table such as that shown in FIG. 11 is created and stored in advance. The dot drop rate table may be interpolated and used as necessary.

After the dot drop rate is found for the calculation target density as described above, the execution drop error is calculated (step 122 of FIG. 8). That is, in step S122, the position error data measurement (err_x[nzl][kind]) of each dot type of the respective nozzles is converted to the execution drop error (Position: err_xx[nzl]).

In the execution drop error, the term "Position: err_xx [nzl]" is calculated as follows:

$$\text{err_xx}[nzl] = \frac{\sum_{kind} (\text{err_x}[nzl][\text{kind}] \cdot \text{dp_buf}[\text{kind}] \cdot \text{volume}[\text{kind}])}{\sum_{kind} (\text{dp_buf}[\text{kind}] \cdot \text{volume}[\text{kind}])} \quad (1)$$

That is, the execution drop error "Position: err_xx[nzl]" is found by weighting the measurement value of the depositing position error using the dot drop rate (dp_buf[kind]) and drop volume (volume[kind]) so as to find a weighted average. Furthermore, a drop volume (volume[kind]) table measures and stores the volume per dot type in advance. FIG. 11 illustrates an example of a dot volume table.

After step S122 of FIG. 8, the flow proceeds to step S123 where the density correction coefficient (coef[nzl]) is calculated and correction is performed. For ease of understanding, this step will be described using a simple, specific example. The following describes, for example, a case where the non-uniformity correction coefficient and misfiring correction coefficient are calculated given three nozzles—the nozzle to be corrected and the left and right nozzles thereof—as the correction window (N=3). In this case, the correction coefficient of the left nozzle, the correction coefficient of the center nozzle, and the correction coefficient of the right nozzle within the correction window are stored in p[0], p[1], and p[2], respectively, Further, calculations are divided into separate cases using the number and positions of misfiring nozzles within the correction window, based on the misfiring information of the head (npn[nzl]). In this example, calculations are cancelled in a case where two or more misfiring nozzles exist within the correction window. FIG. 9 illustrates a specific calculation example.

The operation described below is repeated for all nozzles of the head (step S130).

First, the correction window of the operation target is determined and the operation is divided into the following three pattern cases, in accordance with the number and positions of misfiring nozzles within the correction window. That is, the operation is divided into the three pattern cases of (a) No misfiring nozzles, (b) Center nozzle misfiring, and (c) Left or right nozzle misfiring, and is switched to the applicable processing.

The following processing is performed for "(a) No misfiring nozzles."

The ideal position interval value L (left: −L, center: 0, right: +L) is added to the position error of each nozzle, and the value is converted to an absolute value (a[3]). That is, the following operation is performed:

$$\text{LEFT NOZZLE: } a[0] \leftarrow err_xx[nzl-1]-L$$

$$\text{CENTER NOZZLE: } a[1] \leftarrow err_xx[nzl]+0$$

$$\text{RIGHT NOZZLE: } a[2] \leftarrow err_xx[nzl+1]+L \tag{2}$$

Then, the correction coefficient (p[3]) is calculated using the applicable position error information (a[3]). This calculation will be described later. Here, the three types [0], [1], and [2], which indicate the nozzle position within the correction window, are collectively referred to as [3] for the sake of convenience of notation.

Furthermore, if the position error indicated by the position error information (a[3]) is within a predetermined threshold value (for example, 0.1 μm), correction is regarded as substantially unnecessary, and position correction is not performed. The threshold value that serves as criteria for determining whether or not correction is to be performed is defined from the standpoint of the error permissible range.

The correction coefficient of each nozzle within the correction window is calculated using the following formula:

$$\text{LEFT NOZZLE: } p[0] = \frac{\prod_{k=0,1,2} a[k]}{a[0] \cdot \prod_{k=1,2} (a[k]-a[0])} \tag{3}$$

$$\text{CENTER NOZZLE: } p[1] = \frac{\prod_{k=0,1,2} a[k]}{a[1] \cdot \prod_{k=0,2} (a[k]-a[1])}$$

-continued $$\text{RIGHT NOZZLE: } p[2] = \frac{\prod_{k=0,1,2} a[k]}{a[2] \cdot \prod_{k=0,1} (a[k]-a[2])}$$

Furthermore, for the center nozzle (p[1]), 1 is subtracted. That is, the following is performed:

$$p[1] \leftarrow p[1]-1 \tag{4}$$

Next, the correction coefficient within the correction window found above is added to the non-uniformity correction coefficient (coef[nzl]). That is, the following is performed:

$$coef[nzl-1] \leftarrow coef[nzl-1]+p[0]$$

$$coef[nzl] \leftarrow coef[nzl]+p[1]$$

$$coef[nzl+1] \leftarrow coef[nzl+1]+p[2] \tag{5}$$

The following processing is performed for "(b) Center nozzle is misfiring."

The ideal position interval value L (left: −L, center: 0, right: +L) is added to the position error of each nozzle, and the value is converted to an absolute value (a[3]) (Refer to Equation (2)]). Then, the correction coefficient (p[3]) is calculated using the applicable position error information (a) [3]. This calculation is performed for all nozzles excluding the misfiring nozzle. That is, the calculation is performed as if the misfiring center nozzle is nonexistent.

The correction coefficient of each nozzle within the correction window is calculated as follows:

$$\text{LEFT NOZZLE: } p[0] = \frac{\prod_{k=0,2} a[k]}{a[0] \cdot \prod_{k=2} (a[k]-a[0])} \tag{6}$$

$$\text{RIGHT NOZZLE: } p[2] = \frac{\prod_{k=0,2} a[k]}{a[2] \cdot \prod_{k=0} (a[k]-a[2])}$$

Furthermore, for the center nozzle (p[1]), −1 is substituted.

$$p[1] \leftarrow -1 \tag{7}$$

Then, the correction coefficient within the correction window found above is added to the non-uniformity correction coefficient (coef[nzl]).

That is, the following is performed:

$$coef[nz\mathbf{1}-1] \leftarrow coef[nzl-1]+p[0]$$

$$coef[nzl] \leftarrow coef[nzl]+p[1]$$

$$coef[nzl+1] \leftarrow coef[nzl+1]+p[2] \tag{8}$$

The following processing is performed for "(c) Left or right nozzle is misfiring."

The ideal position interval value L (left: −L, center: 0, right: +L) is added to the position error of each nozzle, and the value is converted to an absolute value (a[3]) (Refer to Equation (2)). Then, the correction coefficient (p[3]) is calculated using the applicable position error information (a[3]). This calculation is performed for all nozzles excluding the misfiring nozzle. That is, the calculation is performed as if the misfiring left or right nozzle is nonexistent.

When the left nozzle is misfiring, the correction coefficient of each nozzle within the correction window is calculated as follows:

When the Left Nozzle is Misfiring:

$$\text{CENTER NOZZLE: } p[1] = \frac{\prod_{k=1,2} a[k]}{a[1] \cdot \prod_{k=2} (a[k] - a[1])} \tag{9}$$

$$\text{RIGHT NOZZLE: } p[2] = \frac{\prod_{k=1,2} a[k]}{a[2] \cdot \prod_{k=1} (a[k] - a[2])}$$

Further, for the center nozzle (p[1]), 1 is subtracted.

$$p[1] \leftarrow p[1]-1 \tag{10}$$

Furthermore, for the left nozzle (p[0]), 0 is substituted.

$$p[0] \leftarrow 0 \tag{11}$$

When the right nozzle is misfiring, the correction coefficient of each nozzle within the correction window is calculated as follows:

When the Right Nozzle is Misfiring:

$$\text{LEFT NOZZLE: } p[0] = \frac{\prod_{k=0,2} a[k]}{a[0] \cdot \prod_{k=2} (a[k] - a[0])} \tag{12}$$

$$\text{CENTER NOZZLE: } p[1] = \frac{\prod_{k=1,2} a[k]}{a[1] \cdot \prod_{k=2} (a[k] - a[1])}$$

When the right nozzle is misfiring:

Further, for the center nozzle (p[1]), 1 is subtracted.

$$p[1] \leftarrow p[1]-1 \tag{13}$$

Furthermore, for the right nozzle (p[2]), 0 is substituted.

$$p[2] \leftarrow 0 \tag{14}$$

Then, the correction coefficient within the correction window found above is added to the non-uniformity correction coefficient (coef[nzl]).

That is, the following is performed:

$$\text{coef[nz1}-1] \leftarrow \text{coef[nzl}-1]+p[0]$$

$$\text{coef[nzl]} \leftarrow \text{coef[nzl]}+p[1]$$

$$\text{coef[nzl}+1] \leftarrow \text{coef[nzl}+1]+p[2] \tag{15}$$

The above operation is repeated for all nozzles within the head (step S130).

After the same processing is executed consecutively for each pixel density, the correction coefficient (coef[j]) for each pixel density is moved to the non-uniformity correction coefficient (COEF[d][j]), misfiring left nozzle correction coefficient (L_COEF[d][j]), and misfiring right nozzle correction coefficient (R_COEF[d]) (step S140). At this time, 1 is added to all data.

Here, as shown in the equation below, the correction coefficient of the nozzle presumed as misfiring (j=nzl) is not moved, the correction coefficient of the nozzle on the left of the nozzle presumed as misfiring (j=nzl+1) is moved to L_COEF[d][j], and the correction coefficient of the nozzle on the right of the nozzle presumed as misfiring (j=nzl−1) is moved to R_COEF[d][j]. Further, the correction coefficient of any nozzle other than the three above (j≠nzl, nzl−1, or nzl+1) is moved to COEF[d][j].

Once the above processing is executed, the calculation processing ends.

The recording characteristics calculating unit 130 and the correction coefficient calculating unit 132 calculate the non-uniformity correction coefficients and the misfiring correction coefficients for cases where each nozzle (discharge unit) is presumed as misfiring, on a per image density and per misfiring area basis, as described above. The calculated non-uniformity correction coefficients and misfiring correction coefficients are stored in the correction coefficient storing unit 120.

Next, the flow of image data processing will be described.

Figure 12:
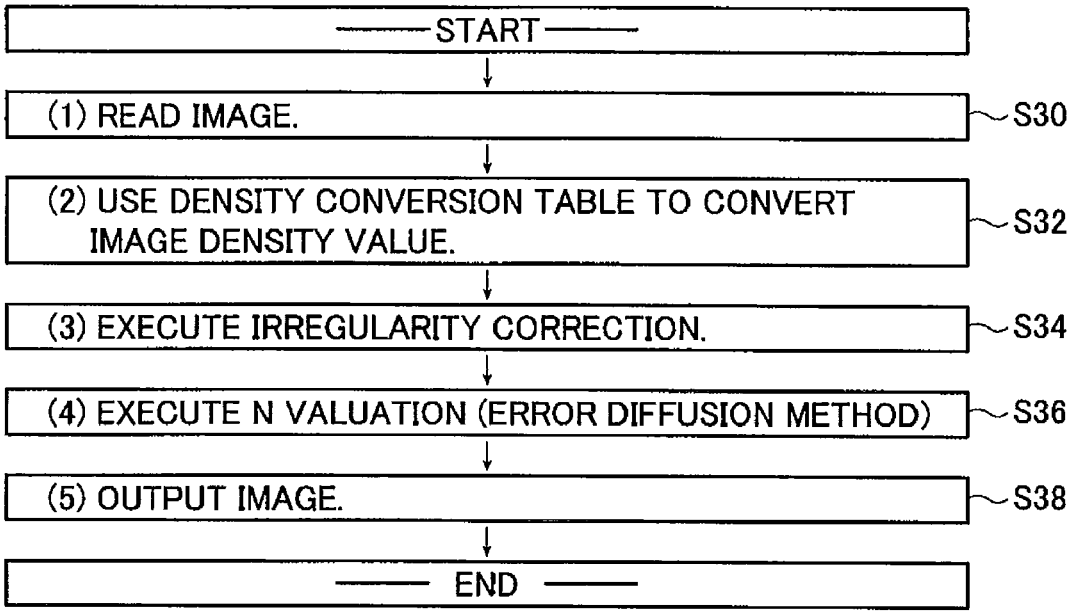
FIG. 12 is a flowchart illustrating the flow of the processing of image data.

FIG. 12 is a flowchart illustrating the flow of image data processing. As described in FIG. 6 as well, first the image data are read (step S30), and the image density value of the image data is converted using the density conversion table (step S32). Non-uniformity correction processing is then performed on this density data (step S34), and N-value conversion processing (in this illustration, an example based on error diffusion will be described later) is performed on the corrected density data (step S36). Then, ink is dropped based on the obtained N-value data (dot data) (step S38).

Figure 13:
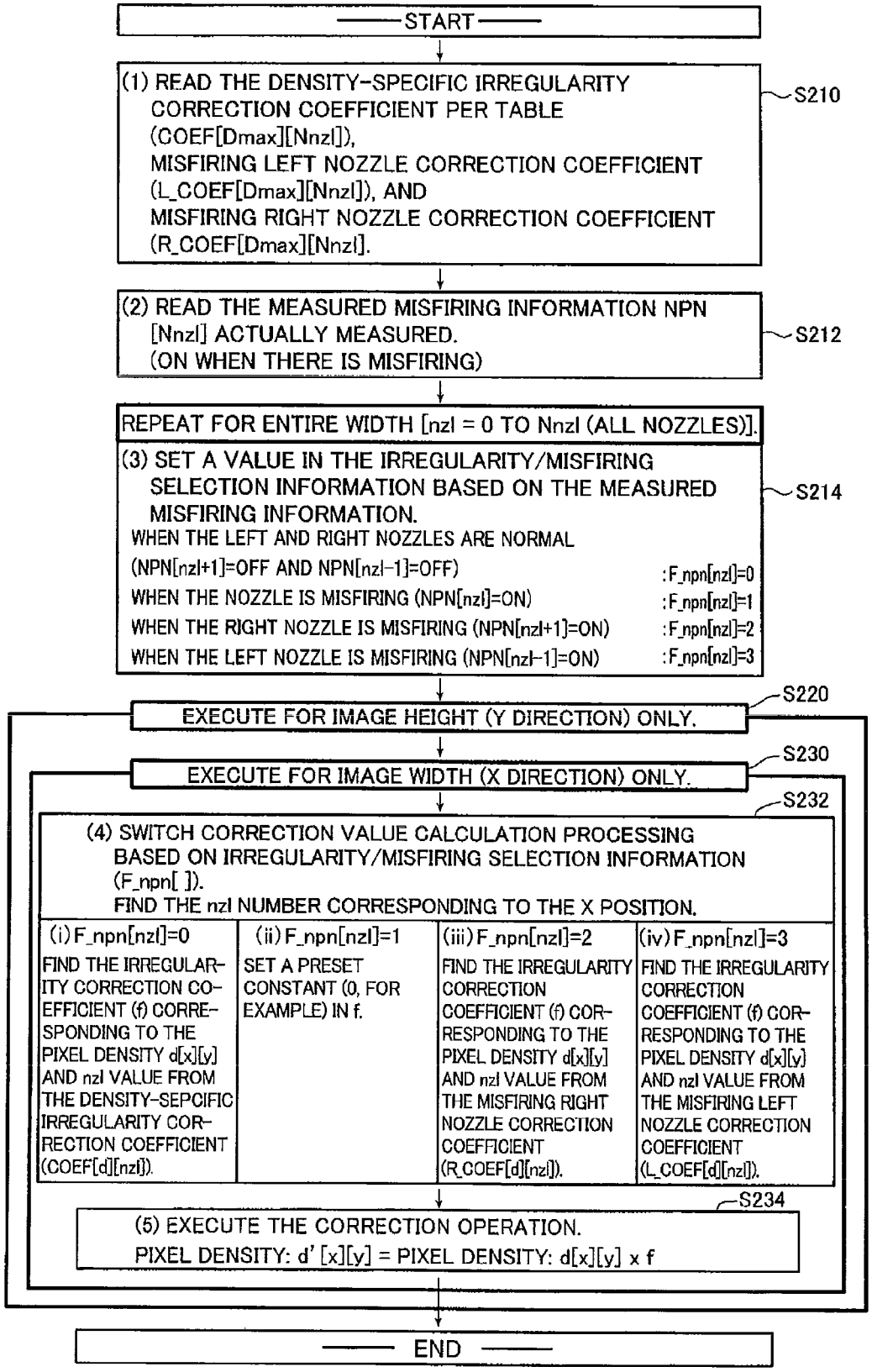
FIG. 13 is a flowchart of non-uniformity correction execution.

FIG. 13 illustrates a detailed example of the non-uniformity correction processing (step S34) shown in FIG. 12.

FIG. 13 is a non-uniformity correction execution flowchart.

When this processing is started, first the density-specific non-uniformity correction coefficient table (COEF[Dmax][Nnzl]), misfiring left nozzle correction coefficient table (L_COEF[Dmax][Nnzl], and misfiring right nozzle correction coefficient table (R_COEF[Dmax][Nnzl] are read (step S210).

Next, the misfiring information (NPN[Nnzl]) actually measured is read (step S212). Here, the measured misfiring information, as described above, may be created by recording a test pattern in which lines are formed on a per nozzle basis, and then detecting whether or not lines corresponding to each nozzle have been formed and detecting any misfiring nozzles. Further, the measured misfiring information is turned ON for a misfiring nozzle and turned OFF for a normal nozzle (a nozzle that discharges ink drops).

Next, based on the read measured misfiring information, non-uniformity/misfiring selection information (F_npn[nzl]) for selecting a table corresponding to each nozzle is created (step S214).

Specifically, when the nozzles to the left and right of the target nozzle (nzl) are normal nozzles, (when NPN[nzl+1]=OFF and NPN[nzl−1]=OFF), then F_npn[nzl]=0; when the target nozzle (nzl) is misfiring, then F_npn[nzl]=1; when the nozzle on the left of the target nozzle (nzl) is misfiring (when NPN[nzl+1]=ON), then F_npn[nzl]=2; and when the nozzle on the right of the target nozzle (nzl) is misfiring (when NPN[nzl−1]=ON), then F_npn[nzl]=3.

Then, while the position (value of y) of the operation target is consecutively changed in the image height direction (y direction), the processing of the following step S230 is repeated for the entire range (step S220).

That is, in step S230, the position (value of x) of the operation target of the image width direction (x direction) at the y value related to the operation target is defined, the nozzle number (nzl number) corresponding to that x position is found, and the pixel density d[x][y], the non-uniformity correction coefficient corresponding to the nzl value, and the misfiring correction coefficient are found from the density-specific non-uniformity correction coefficient table, misfiring left nozzle correction coefficient table, and misfiring right nozzle correction coefficient table (S232).

In a case where F_npn[nzl]=0, the corresponding nzl and non-uniformity correction coefficient of the image density d are read from the density-specific non-uniformity correction coefficient table (COEF[d][nzl]), and the read non-uniformity correction coefficient is set as the correction coefficient (f).

In a case where F_npn[nzl]=1, the correction coefficient (f) is set to a defined constant (0, for example).

In a case where F_npn[nzl]=2, the corresponding nzl and misfiring correction coefficient of the image density d are read from the misfiring left nozzle correction coefficient table (L_COEF[Dmax] [Nnzl]), and the read misfiring correction coefficient (non-uniformity correction coefficient) is set as the correction coefficient (f).

In a case where F_npn[nzl]=3, the corresponding nzl and misfiring correction coefficient of the image density d are read from the misfiring right nozzle correction coefficient table (R_COEF[Dmax][Nnzl]), and the read misfiring correction coefficient (non-uniformity correction coefficient) is set as the correction coefficient (f).

Then, the correction operation is executed as follows, using this correction coefficient (f) (step S234).

$$\text{PIXEL DENSITY: } d'[x][y]=\text{PIXEL DENSITY: } d[x][y]\times f \quad (16)$$

The above steps S232 to S234 are repeated for the entire range of the image width while consecutively changing the position of x of the image width (x direction) (step S230).

Once the above correction operation is completed for all image positions [x][y], the processing ends.

Next, an example of the error diffusion method will be described.

Figure 14:
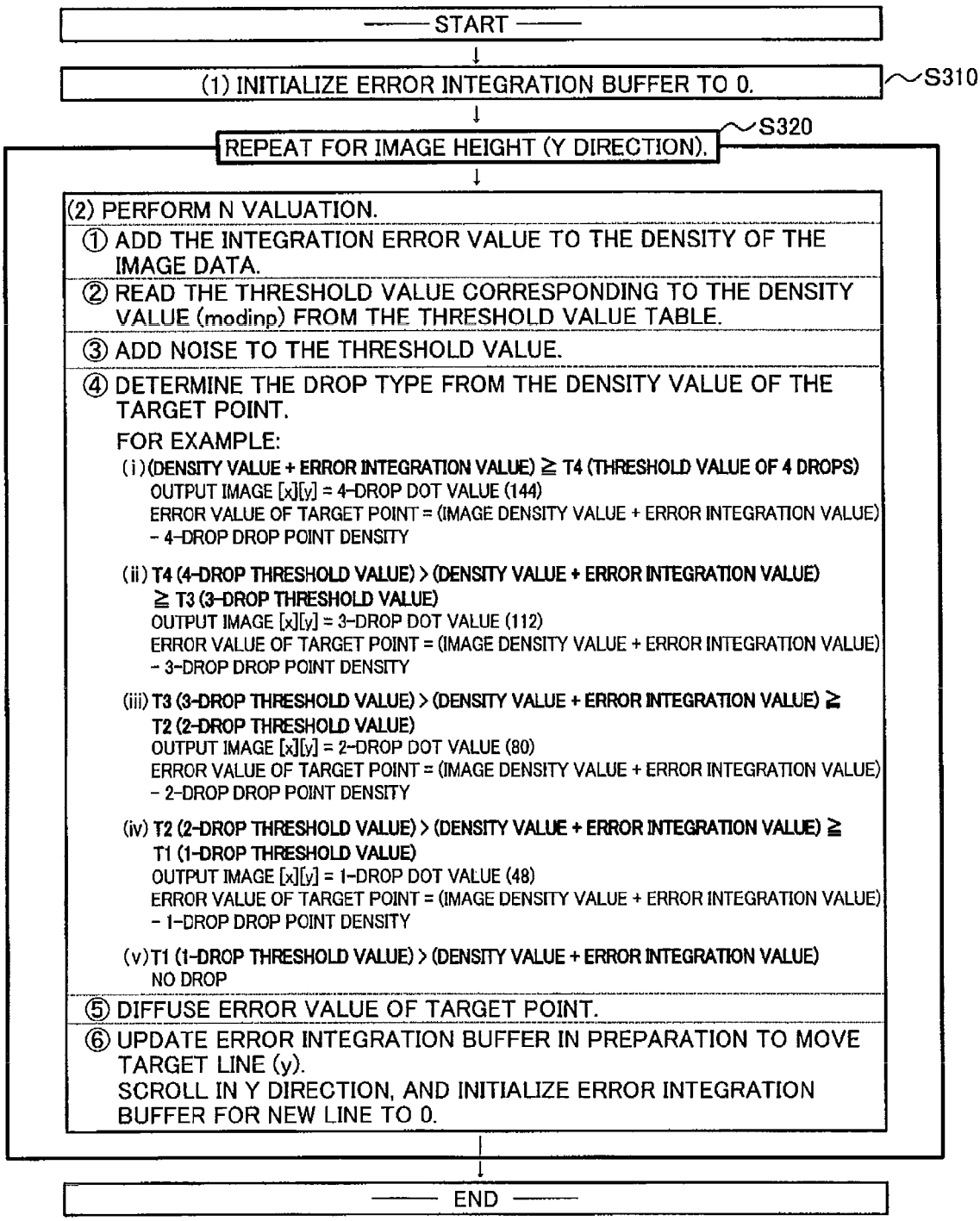
FIG. 14 is a flowchart of the error diffusion method implemented in the N-value conversion processing.

FIG. 14 is a flowchart of the error diffusion method implemented in the N-value conversion processing (step S36) described in FIG. 12.

Figure 15:
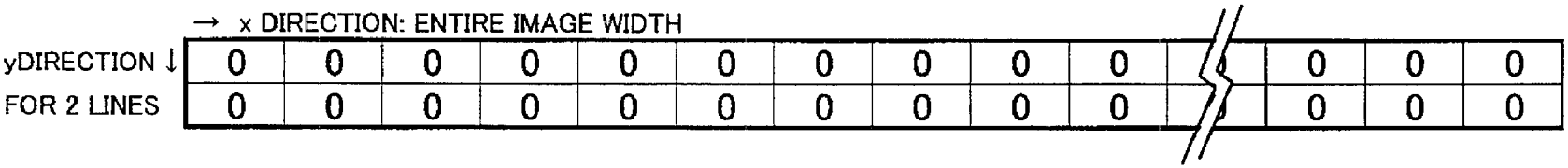
FIG. 15 is an explanatory view illustrating an example of a data storage cell.

When this processing is started, first the error integration buffer is initialized to 0 (step S310). FIG. 15 shows a conceptual diagram of the error integration buffer.

As shown in FIG. 15, the error integration buffer has a data storage cell corresponding to each position of the entire image width in the x direction, and two lines worth of data are storable in the y direction. In step S310 of FIG. 14, the data of each cell are all initialized to zero, as shown in FIG. 15.

Subsequently, while the position (value of y) of the operation target is consecutively changed in the image height direction (y direction), the following processing is repeated for the entire range (step S320 of FIG. 14).

Figure 16:
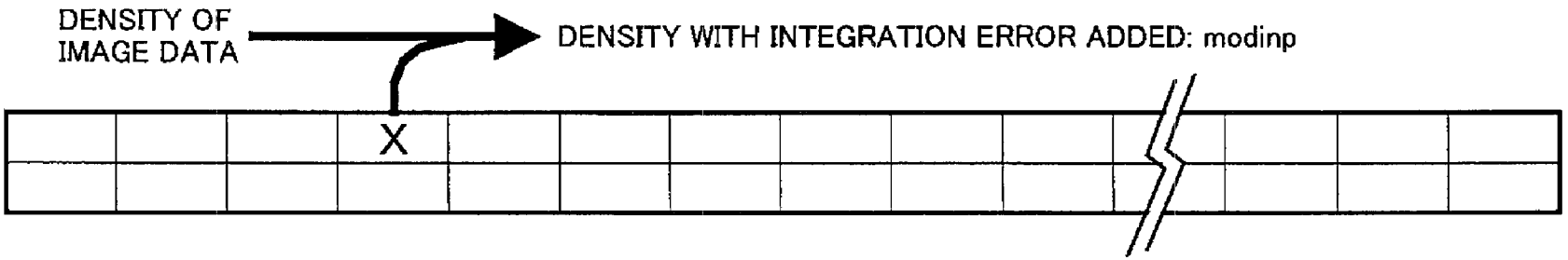
FIG. 16 is an explanatory view for explaining N-value conversion processing.

That is, N-value conversion processing is performed in raster sequence for each x position affiliated with the line of the y value related to the operation target. In the procedure of N-value conversion, first the integration error value is added to the pixel density of the image data for the target position x of the image width direction. FIG. 16 is an explanatory view thereof. For the target position x, the integration error value of the same position of the error integration buffer is added to the pixel density of the image data, and the density with that integration error value added is set as (modinp).

Next, the threshold value corresponding to the density value (modinp) is read from the threshold value table for N-multiplication.

Figure 17:
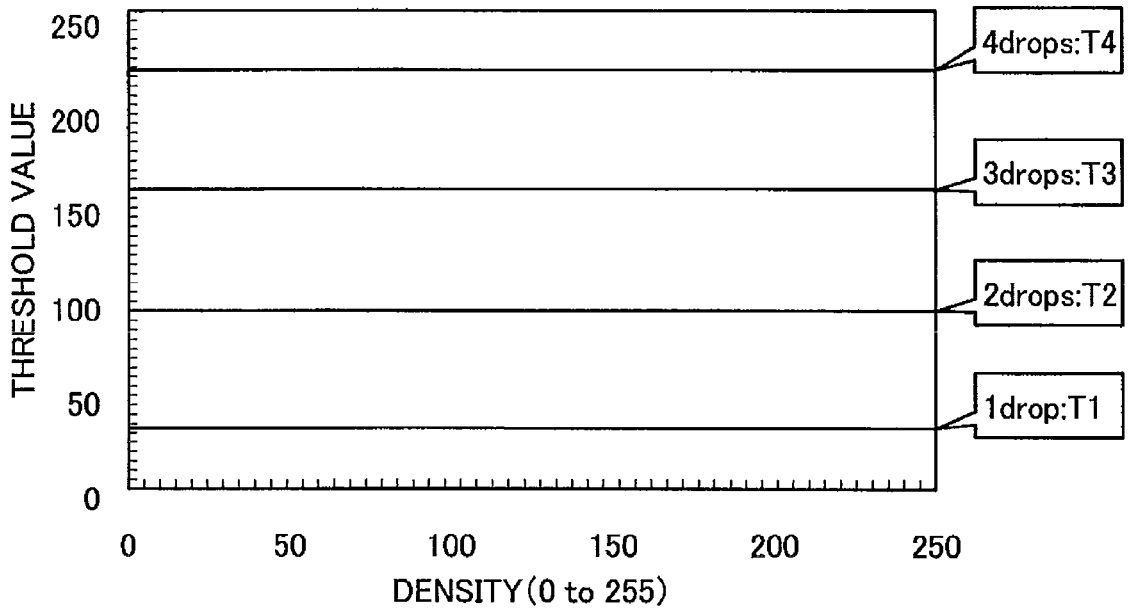
FIG. 17 is an explanatory view illustrating an example of a threshold value table.

FIG. 17 shows an example of a threshold value table. The threshold value table illustrated in the figure is an example of a case where four types of drops are used (5-value conversion), and each threshold value of [1 drop] to [4 drops] is defined as the dot types T1to T4.

Appropriate noise is added to the threshold value read from this threshold value table, and then the drop type is determined from the density value of the target point. In the case of this example, the drop types are determined as follows according to the value of "Density value+Error integration value" and the size of T1, T2, T3, and T4 (refer to FIG. 14).

(i) When the value of "Density value+Error integration value" is greater than or equal to T4

When the value of "Density value+Error integration value" is greater than or equal to T4, the output image (drop point density) of the pixel position [x][y] is defined as a 4-drop dot value (for example, "144" at 8 bits).

The error value of the target point that occurred with this N-value conversion is the value that results when the 4-drop drop-point density is subtracted from the "Density value+Error integration value."

(ii) When the value of "Density value+Error integration value" is greater than or equal to T3 but less than T4

When the value of "Density value+Error integration value" is greater than or equal to T3 but less than T4, the output image (drop point density) of the pixel position [x] [y] is defined as a 3-drop dot value ("112," for example).

The error value of the target point that occurred with this N-value conversion is the value that results when the 3-drop drop-point density is subtracted from the "Density value+Error integration value."

(iii) When the value of "Density value+Error integration value" is greater than or equal to T2 but less than T3

When the value of "Density value+Error integration value" is greater than or equal to T2 but less than T3, the output image (drop point density) of the pixel position [x] [y] is defined as a 2-drop dot value ("80," for example).

The error value of the target point that occurred with this N-value conversion is the value that results when the 2-drop drop-point density is subtracted from the "Density value+Error integration value."

(iv) When the value of "Density value+Error integration value" is greater than or equal to T1 but less than T2

When the value of "Density value+Error integration value" is greater than or equal to T1 but less than T2, the output image (drop point density) of the pixel position [x][y] is defined as a 1-drop dot value ("48," for example). The error value of the target point that occurred with this N-value conversion is the value that results when the 1-drop drop-point density is subtracted from the "Density value+Error integration value."

(v) When the value of "Density value+Error integration value" is less than T1

When the "Density value+Error integration value" is less than T1, the pixel position [x][y] is defined as no drop (drop point density 0)). The error value of the target point that occurred with this N-value conversion is the value of the "Density value+Error integration value" itself.

Next, the error value of the target point that occurred with above N-value conversion of (i) to (v) diffused to unprocessed pixels neighboring the target point.

Figures 18A, 18B:
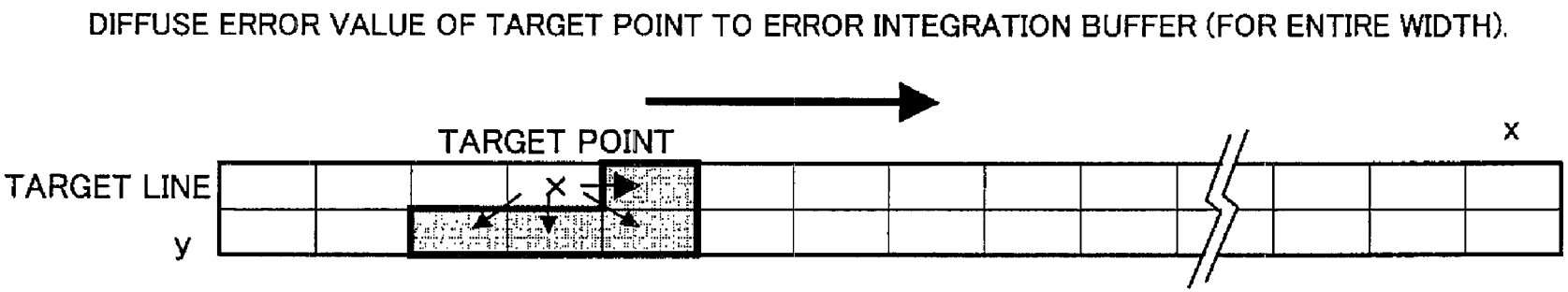
FIG. 18 is a schematic view illustrating an example of an error value diffusion method.

FIGS. 18A and 18B are schematic views illustrating an example of an error value diffusion method.

The four unprocessed positions neighboring the error value that occurred at the target point [x] are respectively partitioned at the respective ratios (partition constants) shown in FIG. 18A.

Figure 19:
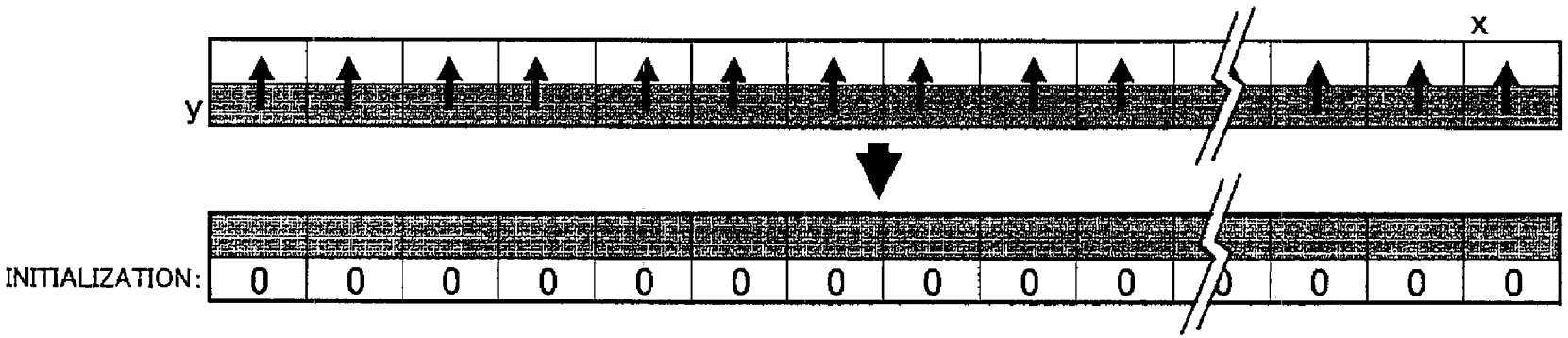
FIG. 19 is an explanatory view for explaining N-value conversion processing.

Once the above N-value conversion is completed for all x positions affiliated with the target line, the target line (y) is changed. At this time, the error integration buffer is updated in preparation for moving the target line (y). That is, as shown in FIG. 19, the error integration buffer is scrolled in the y direction, and the integration buffer for the new line is initialized to zero.

Then, the above processing is repeated for all lines of the image height (y direction) and, once the drop types have been determined for all pixels, the processing ends.

Thus, in N-value conversion processing, the image is subjected to N-value conversion using an error diffusion method such as described above.

Next, the recording operation performed by the image recording device 10 will be described.

First, the recording medium P supplied from the magazine 30 of the feed assembly 12 is decurled and flattened by the heating drum 32. The recording medium P is then cut to a given length by the cutter 34 and fed to the transport assembly 14.

The recording medium P supplied to the transport assembly 14 is positioned on the belt 38 of the suction belt transport unit 36 and transported with the rotation of the belt 38.

The recording medium P transported by the suction belt transport unit 36 passes through the position opposite the heating fan 44 where it is heated to a predetermined temperature, and subsequently passes through the position opposite the recording head unit 50. When the recording medium P passes through the position opposite the recording head unit 50, ink drops are discharged based on the aforementioned discharge control signal from each recording head, the discharged ink drops land on the recording medium in the order of K, C, M, and Y, and an image is formed on the recording medium P.

Furthermore, when the recording medium P passes through the position opposite the recording head module 50, the recording medium P is suctioned by the suction chamber 39, and the distance between the recording medium P and the recording head unit 50 is held constant. Further, color inks are respectively discharged from each recording head 50K, 50C, 50M, and 50Y while the recording medium P is transported, thereby forming a color image on the recording medium P.

The recording medium P on which the image is formed by the recording head unit 50 is further transported by the belt 38 and passes through the position opposite the post-drying unit 53 so as to dry the image area formed by ink and discharge the recording medium P from the first discharge unit 58A while the image area is fixed by the pressure rollers 54.

The image recording device 10, as described above, draws (records) and prints an image on the recording medium P so as to produce printed material.

Figure 20:
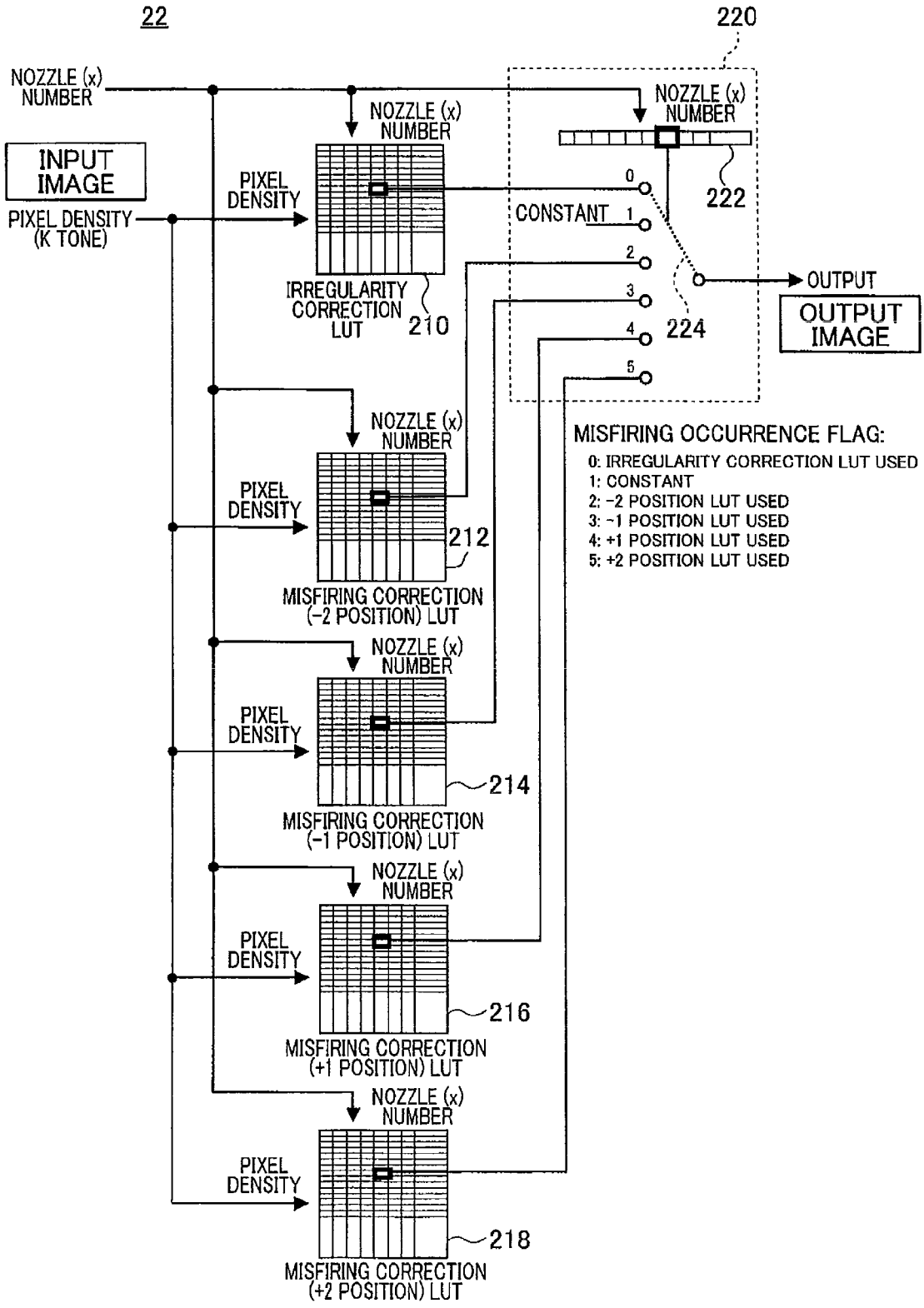
FIG. 20 is an explanatory view conceptually illustrating an example of the relationship between the non-uniformity correction coefficient and misfiring correction coefficient, image density, nozzle position (number), and non-uniformity/misfiring selection information, within the control unit.

The following describes the present invention in further detail with reference to FIG. 20.

FIG. 20 is an explanatory view schematically illustrating an example of the relationship between the non-uniformity correction coefficient and misfiring correction coefficient, image density, nozzle position (number), and non-uniformity/misfiring selection information, within the control unit 22. Here, with the example shown in FIG. 20, a case where the non-uniformities caused by a misfiring nozzle is corrected by the two nozzles on the left and two nozzles on the right of the misfiring nozzle will be described.

As shown in FIG. 20, the control unit 22 comprises a non-uniformity correction LUT 210 that stores the non-uniformity correction coefficient for the two nozzles on the left and two nozzles on the right that are not misfiring, misfiring correction LUTs 212, 214, 216, and 218 that store the misfiring coefficient corresponding to the respective positions (−2 position, −1 position, +1 position, +2 position) with respect to the misfiring nozzle, and selecting means 220. The selecting means 220 is built into the correction processor 138.

Here, the non-uniformity correction LUT 210 stores the non-uniformity correction coefficient for the two nozzles on the left and the two nozzles on the right that are not misfiring.

The misfiring correction LUT (−2 position) 212 stores the misfiring correction coefficient calculated in a case where the nozzle two to the left (i.e., x−2) of the nozzle (x) is presumed to be misfiring, the misfiring correction LUT 214 stores the misfiring correction coefficient calculated in a case where the nozzle (x−1) on the left of the nozzle (x) is presumed to be misfiring, the misfiring correction LUT 216 stores the misfiring correction coefficient in a case where the nozzle (x+1) to the right of the nozzle (x) is presumed to be misfiring, and the misfiring correction LUT 218 stores the misfiring correction coefficient in a case where the nozzle two to the right (i.e., x+2) of the nozzle (x) is presumed to be misfiring.

Further, the non-uniformity correction LUT 210 and the misfiring correction LUTs 212, 214, 216, and 218 store correction coefficients on a per pixel density and nozzle number basis.

The selecting means 220 comprises a flag table 222 that stores the non-uniformity/misfiring selection information of each nozzle, and a LUT switching unit 224, and selects the LUT for reading the correction coefficient based on the flag data and nozzle (x) number.

The flag table 222 stores the non-uniformity/misfiring selection information (flag data) per nozzle number. Here, in this embodiment, 0 is inputted when neither the two nozzles on the left or the two nozzles on the right are misfiring and the correction coefficient of the non-uniformity correction LUT is to be used, 1 is inputted when the nozzle is misfiring and a constant is to be used, 2 is inputted when the nozzle two to the left is misfiring and the correction coefficient of the misfiring correction LUT (−2 position) 212 is to be used, 3 is inputted when the nozzle on the left is misfiring and the correction coefficient of the misfiring correction LUT (−1 position) 214 is to be used, 4 is inputted when the nozzle on the right is misfiring and the misfiring correction LUT (+1 position) 216 is to be used, and 5 is inputted when the nozzle two to the right is misfiring and the correction coefficient of misfiring correction LUT (+2 position) 218 is to be used. This flag table 222 is created from the results when a misfiring nozzle is actually detected.

The LUT switching unit 224 reads the flag data (0 to 5) of the applicable nozzle (x) number from the flag table 222, reads the density correction coefficient or constant supplied from the LUT corresponding to the read flag data, and supplies that value as the density correction coefficient to correction processing means. Furthermore, at this time, the nozzle (x) number and the pixel density data of the input image data are supplied to each LUT, and each LUT supplies the stored correction coefficient to the applicable cell.

The control unit 22 has a configuration such as described above, and the nozzle (x) number used for recording is supplied to each LUT and the selecting means 220, and the pixel density data of the input image is supplied to each LUT.

Each LUT extracts the correction coefficient corresponding to the nozzle (x) number and the pixel density. Next, the selecting means 220 reads the corresponding flag data from the flag table 222 based on the nozzle (x) number, and selects the LUT (or constant) to be used. The image data are corrected using the correction coefficient or constant selected by the selecting means 220 so as to produce an output image.

As described above, according to the present invention, the non-uniformity correction coefficient and the misfiring correction coefficient of each case where a nozzle is misfiring are calculated and stored in advance, making it possible to correct the density non-uniformities caused by the misfiring nozzle by simply switching the non-uniformity/misfiring selection information based on the measured misfiring information of a misfiring nozzle actually measured.

With this arrangement, after a misfiring nozzle is detected, there is no need to newly calculate a correction coefficient that takes into account the misfiring nozzle, making it possible to record an image with the density non-uniformities caused by the misfiring nozzle corrected in a short period of time after the misfiring nozzle is detected.

While, in the above embodiment, the LUT that stores the correction coefficients for each relationship between each nozzles and density is created for each positional relationship with the misfiring nozzle, an index table that stores the relationship with correction coefficients may be provided and identical correction coefficients or correction coefficients within a certain range may be established as one set of data. That is, for identical correction coefficients or correction coefficients within a certain range, the identical correction coefficients in LUT may be used.

In this manner, reference is made to the same data under a plurality of conditions (positional relationships between nozzle position and misfiring nozzle) where the correction coefficients are identical or fall within a certain range, making it possible to decrease the amount of LUT data stored.

Figure 21:
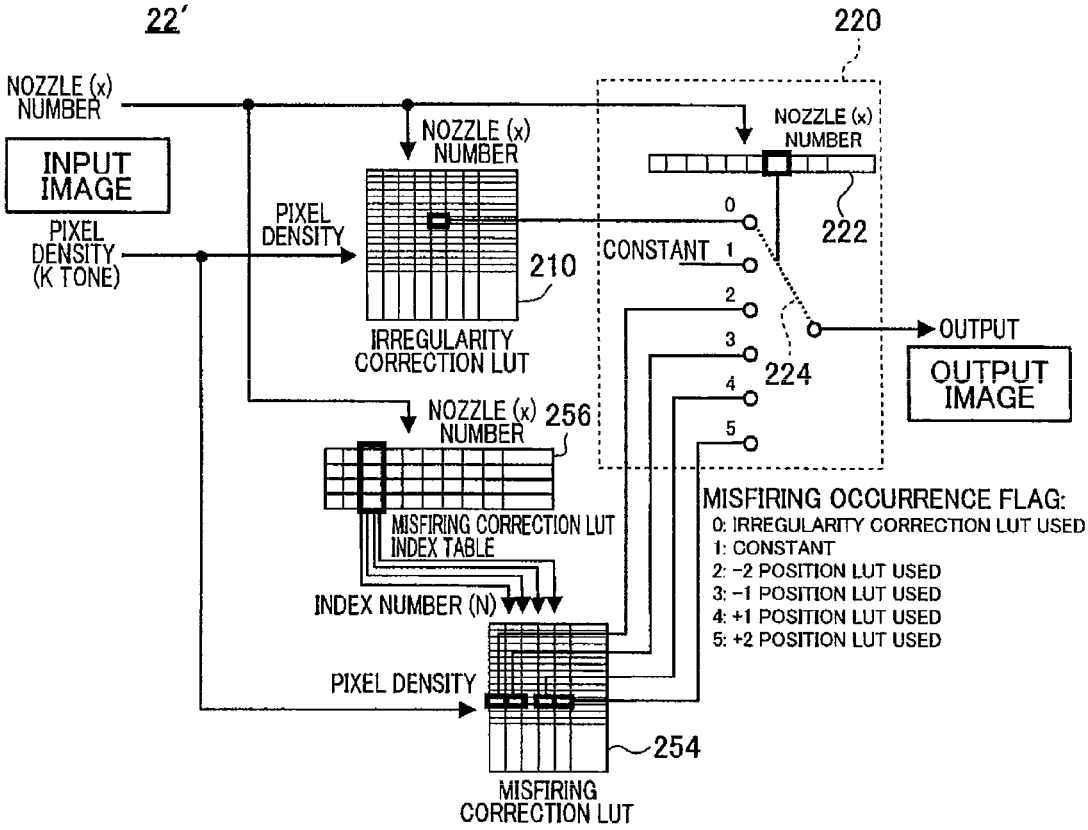
FIG. 21 is an explanatory view conceptually illustrating another example of the relationship between the non-uniformity correction coefficient and misfiring correction coefficient, image density, nozzle position (number), and non-uniformity/misfiring selection information, within the control unit.

FIG. 21 is an explanatory view schematically illustrating another example of the relationship between the non-uniformity correction coefficient and misfiring correction coefficient, image density, nozzle position (number), and non-uniformity/misfiring selection information, within the control unit.

A control unit 22' shown in FIG. 21 comprises the non-uniformity correction LUT 210 that stores the non-uniformity correction coefficients for the two nozzles on the left and two nozzles on the right that are not misfiring, a single misfiring correction LUT 254 that stores a plurality of misfiring correction coefficients, and an index table 256 that instructs (determines) the corresponding (row of) misfiring correction coefficients from the misfiring correction LUT 254 based on the nozzle number.

Here, similar to the control unit 22, the non-uniformity correction LUT 210 stores the non-uniformity correction coefficients for the two nozzles on the left and the two nozzles on the right that are not misfiring.

The misfiring correction LUT 254 is an LUT wherein a plurality of relationships between pixel density and correction coefficient is recorded. Further, the misfiring correction LUT 254 adds an index number for each relationship (row) between pixel density and correction coefficient.

The index table 256 stores the data of the misfiring correction LUT 254 to be used for each nozzle (x) when the nozzle two to the left (i.e., x−2) of nozzle (x) is misfiring, when the nozzle (x−1) to the left of the nozzle (x) is misfiring, when the nozzle (x+1) to the right of the nozzle (x) is misfiring, and when the nozzle two to the right (i.e., x+2) of the nozzle (x) is misfiring. That is, the index table 256 records the index number of the relationship between pixel density and correction coefficient suitable for each positional relationship with the misfiring nozzle of nozzle (x).

Note that the selecting means 220 is the same as the selecting means 220 of the aforementioned control unit 20, and the description thereof will be omitted.

The control unit 22' supplies the nozzle (x) number used for recording to the non-uniformity correction LUT 210, the index table 256, and the selecting means 220, and the pixel density data of the input image data to the non-uniformity correction LUT 210 and the misfiring correction LUT 254.

The non-uniformity correction LUT 210 extracts the correction coefficient corresponding to the nozzle (x) number and the pixel density. Next, the index table 256 determines the row of misfiring correction coefficients to be used for each positional relationship with the misfiring nozzle from the misfiring correction LUT 254, based on the nozzle (x) number. Additionally, the misfiring correction LUT 254 determines the misfiring correction coefficient to be used from the row of the misfiring correction coefficients to be used based on the pixel density supplied.

Next, the selecting means 220 reads the corresponding flag data from the flag table 222 based on the nozzle (x) number, and selects the LUT (or constant) to be used. The image data are corrected using the correction coefficient or constant selected by the selecting means 220 so as to produce an output image.

As described above, an index table is provided and the same correction coefficients or correction coefficients of a similar trend are established as a single set of data, thereby reducing the data amount.

While data can be reduced by establishing a single misfiring correction LUT as in the above embodiment, an index table may also be provided, for example, in a case where an LUT is provided per position with respect to the misfiring nozzle, and the same correction coefficients or correction coefficients of a similar trend may be established as a single set of data within the LUT, thereby reducing the amount of data.

Figure 22:
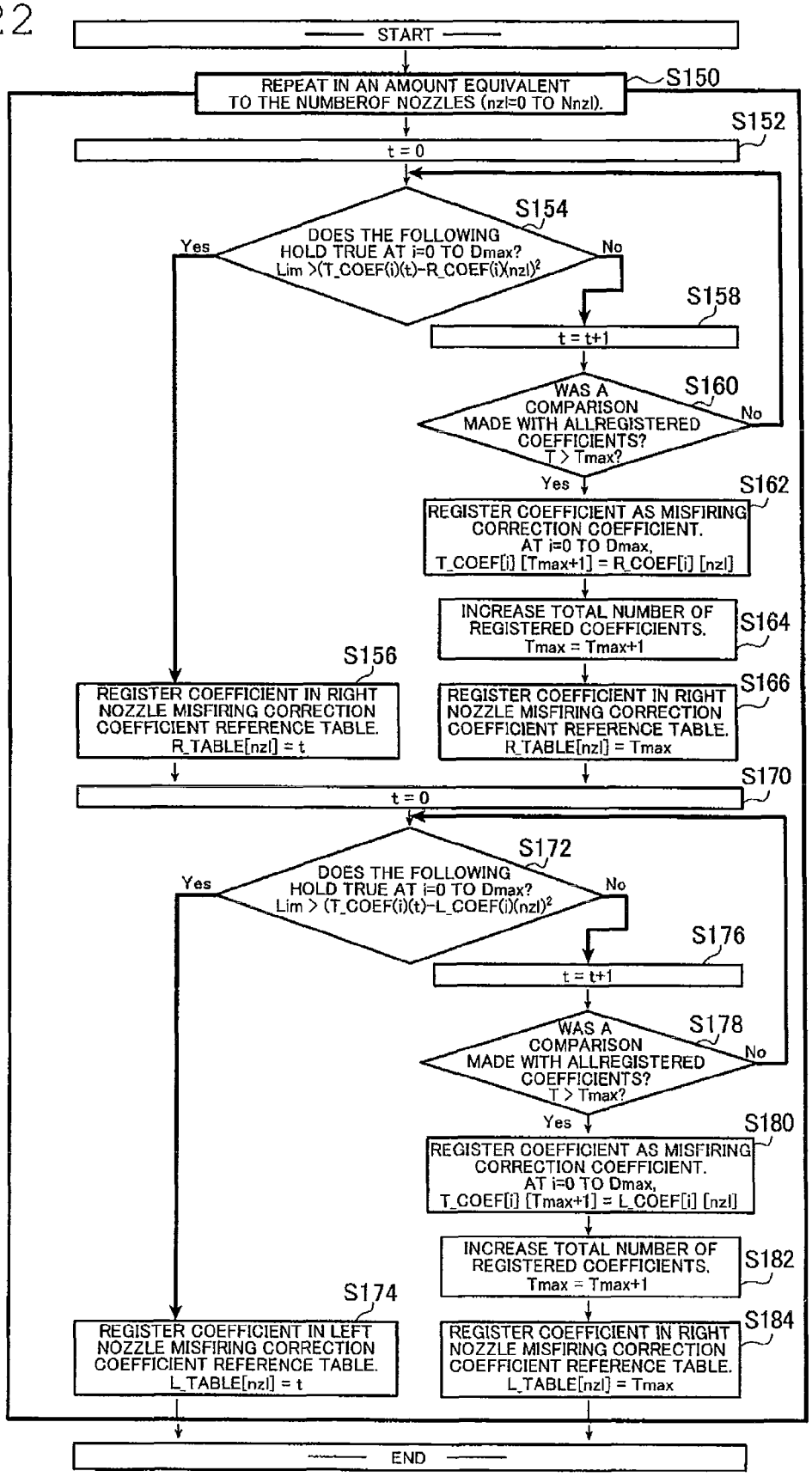
FIG. 22 is a flowchart illustrating a method for creating a misfiring correction LUT.

Next, the method for creating the misfiring correction LUT when an index table is to be provided will be described with reference to FIG. 22. FIG. 22 is a flowchart illustrating a method for creating the misfiring correction LUT. In the example below, the method is described using as an example a case where a misfiring nozzle is corrected using one nozzle to the left and one nozzle to the right of that nozzle. Further, in FIG. 22, the density-specific correction coefficients [the data summarizing the density-specific correction coefficients of a single nozzle (hereinafter "correction coefficient row") are created in the steps illustrated in the aforementioned FIGS. 8 and 9. Note that the method for creating the correction coefficient row is the same as each step illustrated in FIGS. 8 and 9, and a description thereof will be omitted.

In the aforementioned method, after the same processing is executed consecutively for each pixel density, the correction coefficient (coef[j]) for each pixel density is moved to the non-uniformity correction coefficient (COEF[d] [j]), misfiring left nozzle correction coefficient (L_COEF[d][j]), and misfiring right nozzle correction coefficient (R_COEF[d][j]).

In this manner, the moved non-uniformity correction coefficient (COEF[d] [j]) for each nozzle is used as is to create the non-uniformity correction LUT. Additionally, the moved misfiring left nozzle correction coefficient (L_COEF[d][j]) and misfiring right nozzle correction coefficient (R_COEF[d] [j]) for each nozzle is further moved to the misfiring correction LUT according to the following process.

The operation described below is repeated for all nozzles of the head (step S150).

First, t is set to zero (step S152). Here, t is the table number (index number).

Next, at $0 \leqq i \leqq Dmax$, the decision is made as to whether or not $Lim > (TOEF[i][t] - R_COEF[i]\ [nzl])^2$ holds true (step S154). Here, i indicates image density, Lim indicates permissible error, T_COEF[i][t] indicates the misfiring correction coefficient row already stored in the misfiring correction LUT, and the table number is the misfiring correction coefficient row of t.

In this manner, the decision is made as to whether or not the difference of each density between R_COEF[i][nzl] and T_COEF[i][t] is within a certain range.

In a case where the difference of each density is within a certain range, the value is registered in the right nozzle misfiring correction coefficient reference table (R_Table[nzl]; applicable section of index table) (step S156). That is, R_Table[nzl] is set to t. That is, in a case where the nozzle number is nzl and the right nozzle is misfiring, the settings are set so that T_COEF[i][t] is used as the misfiring correction coefficient.

Subsequently, the flow proceeds to step S170.

In step S154, in a case where the error of each density is not within a certain range, t is set to t=t+1 (step S158). That is, t is increased by one.

Next, the decision is made as to whether or not a comparison has been made with all registered coefficients (that is, whether or not t>Tmax) (step S160).

When t≦Tmax, the flow proceeds to step S154 where the decision is made as to whether or not Lim>(T_COEF[i][t]−R_COEF[i] [nzl])$^2$ holds true for the new t.

When t>Tmax, the decision is made that the value does not exist within the permissible range of any T_COEF[i] [t] already stored, and the flow proceeds to step S162.

In step S162, the coefficient is registered in the misfiring correction coefficient table. Specifically, at 0≦i≦Dmax, T_COEF[i][Tmax+1]=R_COEF[i][nzl] is established. That is, R_COEF[i][nzl] is registered as the T_COEF[i][Tmax+1] (that is, Tmax+1 ordered misfiring correction coefficient row).

Next, the total number of registered coefficients is increased (S164). That is, Tmax is increased by one with Tmax=Tmax+1.

Next, the value is registered in the right nozzle misfiring correction coefficient reference table (R_TABLE[nzl]; applicable section of the index table) (step S166). That is, R_TABLE[nzl] is set to Tmax. That is, in a case where the nozzle number is nzl and the right nozzle is misfiring, the settings are set so that T_COEF[i][Tmax] is used as the misfiring correction coefficient.

Subsequently, the flow proceeds to step S170.

In step S170, t is set to t=0.

Next, at 0≦i≦Dmax, the decision is made as to whether or not LIM>(TOEF[i][t]−L_COEF[i][nzl])$^2$ holds true (step S172).

That is, similar to the aforementioned right nozzle misfiring correction coefficient, the decision is made as to whether or not the error of each density between L_COEF[i][nzl] and T_COEF[i][t] is within a certain range.

In a case where the error of each density is within a certain range, the value is recorded in the left nozzle misfiring correction coefficient reference table (L_TABLE[nzl]; applicable section of index table) (step S174). That is, L_Table [nzl] is set to t. That is, in a case where the nozzle number is nzl and the left nozzle is misfiring, the settings are set so that T_COEF[i] [t] is used as the misfiring correction coefficient.

Subsequently, the number of nozzles (nzl) is increased by one, and either the processing is repeated or the processing ends.

In step S172, in a case where the error of each density is not within a certain range, t is set to t=t+1 (step S176). That is, t is increased by one.

Next, the decision is made as to whether or not a comparison has been made with all registered coefficients (that is, whether or not t>Tmax) (step S178).

When t≦Tmax, the flow proceeds to step S172 where the decision is made as to whether or not Lim>(T_COEF[i][t]−L_COEF[i] [nzl])$^2$ holds true for the new t.

When t>Tmax, the decision is made that the value does not exist within the permissible range of any T_COEF[i] [t] already stored, and the flow proceeds to step S180.

In step S180, the coefficient is registered in the misfiring correction coefficient table. Specifically, at 0≦i≦Dmax, T_COEF[i][Tmax+1]=L_COEF[i][nzl] is established. That is, L_COEF[i][nzl] is registered as the T_COEF[i][Tmax+1] (that is, Tmax+1 ordered misfiring correction coefficient row).

Next, the total number of registered coefficients is increased (S182). That is, Tmax is increased by one with Tmax=Tmax+1.

Next, the value is registered in the left nozzle misfiring correction coefficient reference table (L_TABLE[nzl]; applicable section of the index table) (step S184). That is, L_TABLE[nzl] is set to Tmax. That is, in a case where the nozzle number is nzl and the left nozzle is misfiring, the settings are set so that T_COEF[i][Tmax] is used as the misfiring correction coefficient.

Subsequently, the number of nozzles (nzl) is increased by one, and either the processing is repeated or the processing ends.

The above processing is repeated, thereby making it possible to compile the registered misfiring correction coefficient rows that are within a predetermined range (error less than Lim) into a single row, and decrease the amount of data.

Next, a detailed example of non-uniformity correction processing that employs the misfiring correction coefficient tables and the index tables (right nozzle misfiring correction coefficient reference table, left nozzle misfiring correction coefficient reference table) created using the above method will be described.

Figure 23:
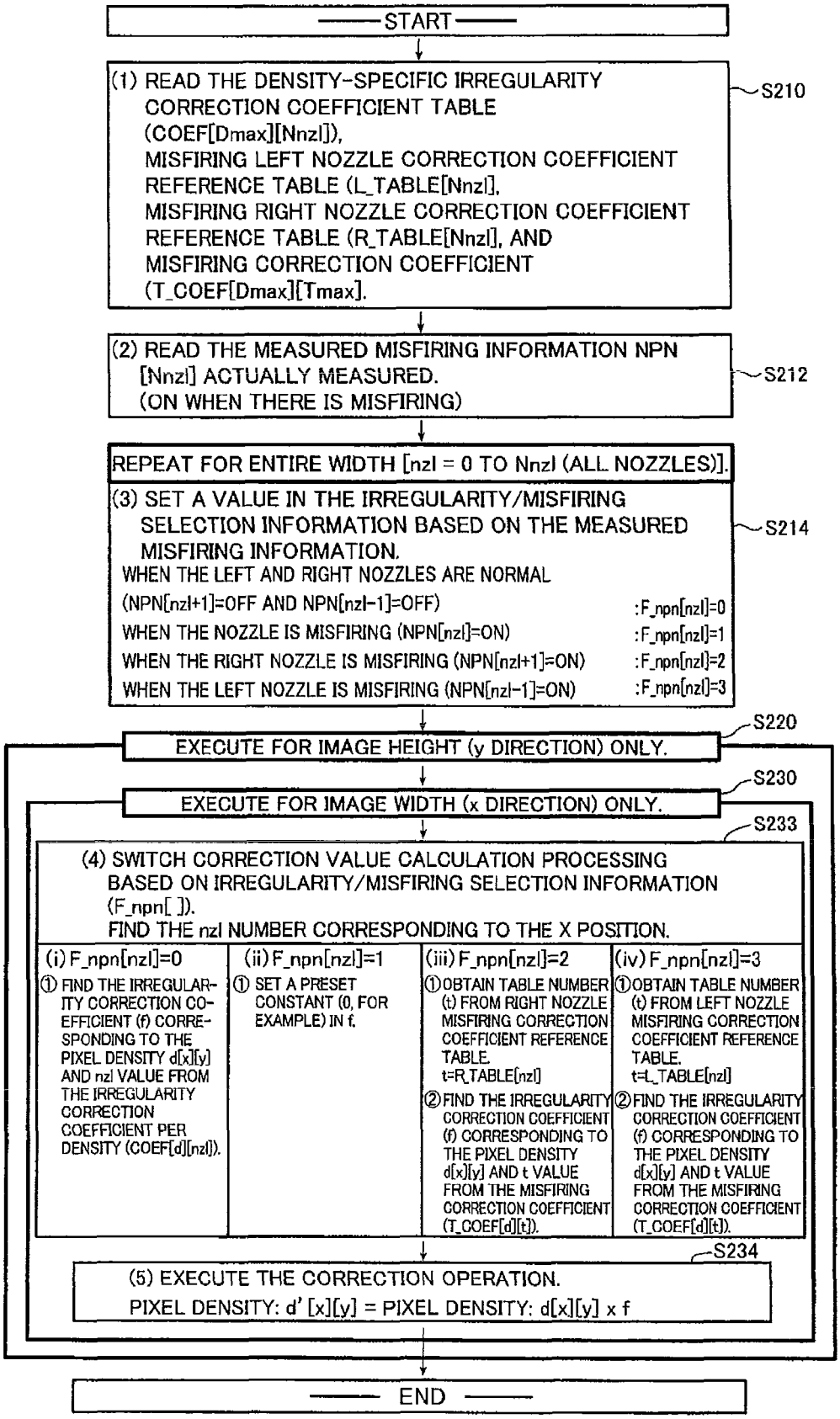
FIG. 23 is a flowchart of non-uniformity correction execution.

FIG. 23 is a non-uniformity correction execution flowchart.

When this processing is started, first the density-specific non-uniformity correction coefficient table (COEF[Dmax] [Nnzl]), misfiring left nozzle correction coefficient reference table (L_TABLE[Nnzl], misfiring right nozzle correction coefficient reference table (R_TABLE[Dmax][Tmax], and misfiring correction coefficient table (T_COEF[Dmax] [Tmax] are read (step S211).

Next, the misfiring information (NPN[Nnzl]) actually measured is read (step S212). Here, the measured misfiring information, as described above, may be created by recording a test pattern in which lines are formed on a per nozzle basis, and then detecting whether or not lines corresponding to each nozzle have been formed and detecting any misfiring nozzles. Further, the measured misfiring information is turned ON for a misfiring nozzle and turned OFF for a normal nozzle (a nozzle that discharges ink drops).

Next, based on the read measured misfiring information, non-uniformity/misfiring selection information (F_npn[nzl]) for selecting a table corresponding to each nozzle is created (step S214).

Specifically, when the nozzles to the left and right of the target nozzle (nzl) are normal nozzles, (when NPN [nzl+1]=OFF and NPN[nzl−1]=OFF), then F_npn[nzl]=0; when the target nozzle (nzl) is misfiring, then F_npn[nzl]=1; when the nozzle on the left of the target nozzle (nzl) is misfiring (when NPN[nzl+1]=ON), then F_npn[nzl]=2; and when the nozzle on the right of the target nozzle (nzl) is misfiring (when NPN[nzl−1]=ON), then F_npn[nzl]=3.

Then, while the position (value of y) of the operation target is consecutively changed in the image height direction (y direction), the processing of the following step S230 is repeated for the entire range (step S220).

That is, in step S230, the position (value of x) of the operation target of the image width direction (x direction) at the y value related to the operation target is defined, the nozzle number (nzl number) corresponding to that x position is found, and the pixel density d[x][y], the non-uniformity correction coefficient corresponding to the nzl value, and the misfiring correction coefficient are found from the density-specific non-uniformity correction coefficient table, misfiring left nozzle correction coefficient table, and misfiring right nozzle correction coefficient table (S233).

In a case where F_npn[nzl]=0, the corresponding nzl and non-uniformity correction coefficient of the image density d are read from the density-specific non-uniformity correction coefficient table (COEF[d][nzl]), and the read non-uniformity correction coefficient is set as the correction coefficient (f).

In a case where F_npn[nzl]=1, the correction coefficient (f) is set as a defined constant (0, for example).

In a case where F_npn[nzl]=2, the table number (t) is read from the corresponding nzl from the misfiring left nozzle correction coefficient reference table (L_TABLE [Nnzl]), and the non-uniformity correction coefficient (T_COEF[d][t]) corresponding to the pixel density [d] and the table number (t) read from the misfiring correction coefficient table (T_COEF[Dmax][Tmax] is read. The read misfiring correction coefficient (non-uniformity correction coefficient) is set as correction coefficient (f).

In a case where F_npn[nzl]=3, the table number (t) is read from the corresponding nzl from the misfiring left nozzle correction coefficient reference table (R_TABLE[Nnzl]), and the non-uniformity correction coefficient (T_COEF[d][t]) corresponding to the pixel density [d] and the table number (t) read from the misfiring correction coefficient table (T_COEF [Dmax] [$T_{max}$]) is read. The read misfiring correction coefficient (non-uniformity correction coefficient) is set as correction coefficient (f).

Then, a correction operation is executed according to the aforementioned Equation (16), using the correction coefficient (f) (step S234).

The above steps S232 to S234 are repeated for the entire range of the image width while consecutively changing the position of x of the image width (x direction) (step S230).

Once the above correction operation is completed for all image positions [x][y], the processing ends.

Thus, when the index tables and the misfiring correction coefficient row common to a plurality of nozzle are used, non-uniformity correction can be performed by the processing described above.

Further, while in the above embodiment only the depositing position error of each discharge unit is set as recording characteristics and the variance in the dots formed by each recording element is not taken into account, the present invention is not limited thereto and the drop diameter (drop volume) formed by each discharge unit may be calculated so as to take into account the variance in the diameter of the drop point formed by each discharge unit. When the variance in drop volume between each drop point formed by the discharge units is taken into account in this manner, the overlapping volume can be more accurately detected, making it possible to reproduce an image more accurately.

Furthermore, as described in JP 2006-26406 A, for example, the diameter of the drop point formed by each discharge unit may be calculated by detecting the density profile of each straight line and detecting the width of that line.

Further, while calculation of the density correction coefficient based on depositing position error is preferably performed for all discharge units, the present invention is not limited thereto and the system may be configured so that only those discharge units having a shift in depositing position greater than or equal to a certain amount are subject to correction, and only the density non-uniformities of those discharge units that cause recording characteristics such as a depositing position error or the like are corrected.

Further, while in the above embodiment, the density non-uniformity correction coefficient and misfiring correction coefficient are calculated in the correction coefficient calculating unit, the calculating unit may be separated into a calculating unit that calculates the density non-uniformity correction coefficient and a calculating unit that calculates the misfiring correction coefficient. The same holds true for the storing unit as well.

Further, while in the present embodiment straight lines divided into four sections are formed as the test pattern, the present invention is not limited thereto and straight lines divided into two sections, three sections, or five sections may be formed.

Furthermore, while in the above embodiment a straight line is used, depositing positions may be detected based on a single drop point.

Further, if neighboring drop points are not in contact on the recording medium, i.e., if there is no contact between a drop point and a neighboring drop point, the drop points formed by all discharge units may be formed on the same line in a direction perpendicular to the transport direction of the recording medium.

For example, in a case where the size of the ink drop to be discharged is adjustable, i.e., in a case where the size of the drop point is adjustable, the ink drop to be discharged can be made smaller so as to decrease the size of the drop point, thereby ensuring that the drop point and a neighboring drop point do not contact one another.

By ensuring that a drop point and a neighboring drop point do not contact one another in this manner, it is possible to accurately calculate both ends of the respective drop points in the reference direction.

Further, while in the present embodiment the image data are converted into multi-value data (five-value conversion; i.e., four types of drop points and no drop formation) by the ink discharge data refining unit, thereby generating a discharge control signal, the present invention is not limited thereto and the data may be converted into N-value data (where N≧2) in accordance with the discharge performance of the recording head. For example, in a case where a recording head is capable of discharging large dots and small dots, the image data may be subjected to three-value conversion processing so as to generate a discharge control signal comprising the three values of large dot, small dot, and no discharge. Further, the image data may be subjected to binarization, which includes the values of discharge and no discharge.

Figure 24:
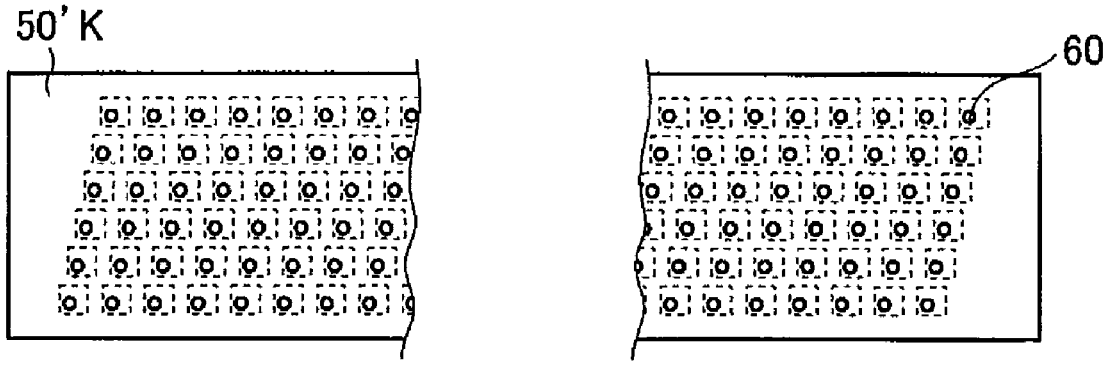
FIG. 24 is a detailed view illustrating another example of the arrangement pattern of the discharge units of the recording head.

Further, while in the above embodiment the recording head of the drawing unit is a full-line head wherein the discharge units are arranged in one row in the shape of a line, the present invention is not limited to a single row arrangement and, as shown in FIG. 24, a recording head 50'K may comprise a plurality of rows of discharge units that are staggered at a certain pitch. Staggering the discharge units 60 and forming a row of drop points by a plurality of rows of discharge units makes it possible to form an image having an even higher resolution.

Further, while in the present embodiment the recording head unit comprises the (four) standard colors YMCK, combinations of the ink colors or the number of colors are not limited to those. Light inks or dark inks can be added. More specifically, a configuration is possible in which recording heads for ejecting light-colored inks such as light cyan and light magenta are added.

Further, the recording head unit may be established as only a recording head that discharges K (black) ink, i.e., a single-color recording head, and used as an image drawing device that draws images of one color.

While the above described in detail the image recording method and image recording device according to the present invention, note that the present invention is not limited to the above embodiment and various modifications may be made without departing from the spirit and scope of the invention.

For example, while the above-described image recording device uses thermosetting ink and fixes the ink that lands on the recording medium to the recording medium by a heating/pressing assembly, the present invention is not limited thereto and various types of inks may be used. For example, in a case where a light curing ink is used, the image may be fixed to the recording medium by providing a light irradiating mechanism as the fixing unit, discharging active energy curing ink from the recording head, forming an image of light curing ink on the recording medium P, and subsequently irradiating active light beams onto the image so as to cure the image. Here, in a case where UV curing ink is used as the light curing ink, a metal halide lamp, high-pressure mercury lamp, or an ultraviolet light source such as an UV LED may be used as the fixing unit.

Further, while in the embodiment the device used was described as an image recording device, the present invention is not limited thereto and, as described in detail later using a specific example, an image recording device that fixes an image onto the recording medium P by heating and pressing an image recorded on the recording medium P may also be used.

A specific example of the method for calculating the density correction coefficient based on a depositing position error will now be described.

In the following, the density correction coefficient p[i] is referred to as di and the depositing position error a[i] is referred to as xi.

As described above, the density correction coefficient di with respect to the depositing position error of a specific nozzle is determined as follows:

$$d_i = \begin{cases} \dfrac{\prod_k x_k}{x_i \cdot \prod_{k \neq i} (x_k - x_i)} - 1 & \text{(NOZZLE TO BE CORRECTED)} \\ \dfrac{\prod_k x_k}{x_i \cdot \prod_{k \neq i} (x_k - x_i)} & \text{(NOZZLE OTHER THAN NOZZLE TO BE CORRECTED)} \end{cases} \tag{17}$$

Here, xi is the depositing position of each nozzle, taking the origin at the ideal depositing position of the nozzle subject to correction. Π means that the product is found for the N nozzles used for correction. When stated explicitly for the case of N=3, the following equations are derived:

$$d_2 = \frac{x_2 \cdot x_3 \cdot x_4}{x_2 \cdot (x_3 - x_2) \cdot (x_4 - x_2)}$$
$$d_3 = \frac{x_2 \cdot x_3 \cdot x_4}{x_3 \cdot (x_2 - x_3) \cdot (x_4 - x_3)} - 1 \tag{18}$$
$$d_4 = \frac{x_2 \cdot x_3 \cdot x_4}{x_4 \cdot (x_2 - x_4) \cdot (x_3 - x_4)}$$

It is possible to logically derive the density correction coefficient for each nozzle from the conditions for minimizing the low-frequency components of the power spectrum of the density non-uniformity.

First, a density profile incorporating the error characteristics of each nozzle (i.e., discharge unit) is defined as:

$$D(x) = \sum_i D_i \cdot z(x - x_i) \tag{19}$$

| | |
|---|---|
| i | NOZZLE NUMBER |
| x | MEDIA POSITION COORDINATES (NOZZLE COLUMN DIRECTION) |
| $D_i$ | NOZZLE OUTPUT DENSITY (HEIGHT OF PEAK) |
| z(x) | STANDARD DENSITY PROFILE (x = 0 IS BARYCENTRIC POSITION) |
| $x_i = \overline{x}_i + \Delta x_i$ | DEPOSITING POSITION OF NOZZLE i (IDEAL POSITION + ERROR) |

The density profile D(x) of the image is the sum of the density profiles printed by each nozzle, and the print model represents the printing performed by each nozzle (the density profile printed by each nozzle). The print model is represented separately by the nozzle output density Di and the standard density profile z(x).

The standard density profile z (x) has a limited spread that is equal to the dot diameter in strict terms, but if the correction of position errors is considered to be a problem of balancing divergences in the density, then the important element is the barycentric position (depositing position) of the density profile and the spread of the density profile is a secondary factor. Hence, an approximation that converts the profile by means of a δ function is appropriate. When such a standard density profile is supposed, then an arithmetical treatment can be achieved readily, making it possible to obtain a precise solution for the correction coefficients.

In a case where the profile is approximated using the δ function model, the standard density profile is expressed by the following:

$$\delta\text{FUNCTION MODEL: } z(x-x_i)=\delta(x-x_i) \tag{20}$$

In calculating the correction coefficients, it is considered that the depositing position error Δx0 of a particular nozzle (i=0)) is to be corrected by means of N pieces of surrounding nozzles. Here, the number of the nozzle to be corrected is i=0. Note that each of the surrounding nozzles may also have a predetermined depositing position error.

The numbers (indexes) of the N nozzles including the nozzle to be corrected (center nozzle) are represented as:

$$\text{NOZZLE index: } i = -\frac{N-1}{2}, \ldots -1, 0, 1, \ldots \frac{N-1}{2} \tag{21}$$

(*N* NOZZLES TOTAL, INCLUDING CENTER NOZZLE)

The number N must be an odd number in this expression, but in implementing the present invention, the number N is not necessarily limited to being an odd number.

The initial output density (the output density before correction) has a value only if i=0, and is represented as follows:

$$D_i = \begin{cases} D_{ini} & (i = 0) \\ 0 & (i \neq 0) \end{cases} \tag{22}$$

When the density correction coefficients are di, then the output densities Di' after correction are represented as follows:

$$D'_i = D_i + d_i \times D_{ini} = d'_i \times D_{ini} \tag{23}$$

$$\text{WHERE, } d'_i = \begin{cases} d_i + 1 & (i = 0) \\ d_i & (i \neq 0) \end{cases}$$

In other words, when i=0, the corrected output density Di' is the sum of the initial output density value and the correction value (di x Dini), and when i≠0, the corrected output density is equal to the correction value only.

The depositing position xi of each nozzle i is represented as:

DEPOSITING POSITION: $x_i = \bar{x}_i + \Delta x_i$ WHERE, $\bar{x}_i$ IS THE IDEAL DEPOSITING POSITION, $\Delta x_i$ IS THE DEPOSITING POSITION ERROR, AND THE IDEAL DEPOSITING POSITION OF THE NOZZLE TO BE CORRECTED IS SET AS THE ORIGIN POINT ($\bar{x}_0$=0) (24)

When using a δ function type print model, the density profile after correction is expressed as follows:

$$\begin{aligned} D(x) &= \sum_{i=-(N-1)/2}^{i=(N-1)/2} D'_i \cdot \delta(x - x_i) \\ &= D_{ini} \cdot \sum_{i=-(N-1)/2}^{i=(N-1)/2} d'_i \cdot \delta(x - x_i) \end{aligned} \tag{25}$$

By Fourier transform on this equation, the following equation is obtained:

$$\begin{aligned} T(f) &= \int_{-\infty}^{\infty} D(x) \cdot e^{ifx} dx \\ &= \sum_i d'_i \cdot \int_{-\infty}^{\infty} \delta(x - x_i) \cdot e^{ifx} dx \\ &= \cdot \sum_i d'_i \cdot e^{ifx_i} \end{aligned} \tag{26}$$

Note that Dini is a common constant and therefore omitted.

Minimizing the visibility of density non-uniformities means minimizing the low frequency components of the power spectrum expressed as:

$$\text{POWER SPECTRUM} = \int T(f)^2 df \tag{27}$$

This can be approximated arithmetically by taking the differential coefficients (of the first-order, second-order, . . . ) for f=0 in T(f) to be zero. Since there are N unknown numbers di', then if conditions are used where the differential coefficients up to the (N−1)-th order are zero, and also including the condition for maintaining the direct current (DC) component, then all (N) of the unknown numbers of di' can be specified precisely. Thus, the following correction conditions are specified:

$$\text{DC COMPONENT } T(f = 0) = 1 \tag{28}$$

$$\text{PRIMARY COEFFICIENT } \frac{d}{df} T(f = 0) = 0$$

$$\text{SECONDARY COEFFICIENT } \frac{d^2}{df^2} T(f = 0) = 0$$

$$\ldots$$

$$N - 1th \text{ ORDER COEFFICIENT } \frac{d^{N-1}}{df^{N-1}} T(f = 0) = 0$$

In the δ function model, when the correction conditions are developed, N simultaneous equations relating to Di are reached by means of a simple calculation. When the correction conditions are rearranged, the following group of conditions (group of equations) is obtained:

$$\Sigma d'_i = 1$$

$$\Sigma x_i d'_i = 0$$

$$\Sigma x_i^2 d'_i = 0$$

$$\Sigma x_i^{N-1} d'_i = 0 \tag{29}$$

The meaning of this group of equations is that the first equation represents the preservation of the DC component, and the second equation represents the preservation of the barycentric position. The third and subsequent equations represent the fact that the (N−1)-th moment in the statistical calculation is zero.

The conditional equations thus obtained can be represented with a matrix format as follows:

$$\begin{pmatrix} 1 & \cdots & 1 & \cdots & \cdots & 1 \\ x_{-(N-1)/2} & \cdots & x_0 & \cdots & \cdots & x_{(N-1)/2} \\ x^2_{-(N-1)/2} & \cdots & x_0^2 & & \cdots & x^2_{(N-1)/2} \\ \vdots & & & \ddots & & \vdots \\ \vdots & & & & \ddots & \vdots \\ x^{N-1}_{-(N-1)/2} & \cdots & x_0^{N-1} & \cdots & \cdots & x^{N-1}_{(N-1)/2} \end{pmatrix} \begin{pmatrix} d'_{-(N-1)/2} \\ \vdots \\ \vdots \\ d'_0 \\ \vdots \\ d'_{(N-1)/2} \end{pmatrix} = \begin{pmatrix} 1 \\ 0 \\ \vdots \\ 0 \\ \vdots \\ 0 \end{pmatrix} \tag{30}$$

This coefficient matrix A is a so-called Vandermonde matrix, and it is known that this matrix equation can be converted to the following equation by using the product of the difference:

$$|A| = \prod_{j>k} (x_j - x_k) \tag{31}$$

Accordingly, it is possible to determine the precise solution of di' using the Crammer's formula. The detailed sequence of the calculation is omitted here, but by means of algebraic calculation, the following solution is obtained:

$$d_i' = \frac{\prod_k x_k}{x_i \cdot \prod_{k \neq i} (x_k - x_i)} \tag{32}$$

Therefore, the correction coefficients di are determined as follows:

$$d_i = \begin{cases} \dfrac{\prod_k x_k}{x_i \cdot \prod_{k \neq i} (x_k - x_i)} - 1 & (i = 0) \\ \dfrac{\prod_k x_k}{x_i \cdot \prod_{k \neq i} (x_k - x_i)} & (i \neq 0) \end{cases} \tag{33}$$

Thus, the precise solution for the density correction coefficients di is found from the conditions where the differential coefficients at the origin of the power spectrum become zero. As the number of nozzles N used in correction increases, the possibility of making the higher-order differential coefficients become zero increases, and hence, the low-frequency energy becomes smaller and the visibility of non-uniformities is reduced even further.

In the present embodiment, the conditions where the differential coefficients at the origin become zero are used, but if the differential coefficients become sufficiently small values compared to the differential coefficients before the correction (such as 1/10 of the values before the correction), rather than being set completely at zero, it is possible to make the low-frequency components of the power spectrum of the density non-uniformity sufficiently small. In other words, from the viewpoint of achieving conditions where the low-frequency components of the power spectrum are reduced to the extent by which density non-uniformities become invisible, it is acceptable that the differential coefficients of the power spectrum at the origin are set to sufficiently small values (approximately zero), and that the range of each differential coefficient after correction can be set up to 1/10 of the absolute value of the differential coefficient before correction.

If the human visual characteristics are taken into consideration, then the visibility of density non-uniformity is represented by the power spectrum in the low-frequency region of the spatial frequency of 0 to 8 cycles/mm, and the smaller the power spectrum in this region, the greater the correction accuracy.

Further, if the density correction coefficient for a nozzle i in relation to the position error of a nozzle k is set to be d (i, k), then the value of this d (i, k) is determined by the above Equation (16). Then, the total density correction coefficient di for the nozzle can be found as follows:

$$d_i = \sum_k d(i, k) \tag{34}$$

In this embodiment, d (i, k) are accumulated for the index k assuming that the depositing position errors of all of the nozzles are to be corrected, but it is also possible to adopt a configuration in which a certain value ΔX_thresh is preset as a threshold value, and correction is performed selectively by setting as targets of correction only those nozzles having a depositing position error exceeding this threshold value.

As stated above, the accuracy of correction tends to increase as the value of the number of nozzles N used for correction rises, but this also increases the breadth of change of the density correction coefficients and may lead to disruption of the reproduced image. Accordingly, it is advantageous to determine in advance a limited correction coefficient range (upper limit: d_max, lower limit: d_min) in order to prevent the occurrence of image disruption, and set the value N in such a manner that the total density correction coefficient determined by the above Equation (23) falls within this limited range. In other words, the value N is set in such a manner that the relationship of d_min<di<d_max is satisfied.

From experimental observation, it is known that image disruption does not occur provided that d_min≧−1 and d_max≦1.

What is claimed is:

1. An image recording device for recording an image on a recording medium according to image data including pixel density data, comprising:

a recording head that has a plurality of recording elements configured to discharge ink drops;

transport means that causes the recording head and the recording medium to move relatively to each other by transporting at least one of the recording head and the recording medium;

non-uniformity information acquiring means that acquires non-uniformity information of each recording element by using a test pattern;

non-uniformity correction coefficient calculating means that calculates a non-uniformity correction coefficient value for each density based on the non-uniformity information of each recording element acquired by the non-uniformity information acquiring means as recording characteristics of the recording element;

misfiring correction coefficient calculating means that calculates a misfiring correction coefficient value for each density in a case where a nearby recording element is misfiring based on the non-uniformity information of each recording element acquired by the non-uniformity information acquiring means as the recording characteristics of the recording element;

misfiring information detecting means that detects misfiring information of the recording elements;

selecting means that selects the recording characteristics calculated by the non-uniformity correction coefficient calculating means for each recording element a nearby recording element of which is not determined to he misfiring and selects the recording characteristics calculated by the misfiring correction coefficient calculating means for each recording element a nearby recording element of which is determined to be misfiring based on the pixel density data and the misfiring information detected by the misfiring information detecting means;

correction processing means that corrects the pixel density data of the image data using the recording characteristics selected by the selecting means; and drive control means that drives the recording element based on the image data including the pixel density data corrected by the correction processing means.

2. The image recording device according to claim 1, wherein the misfiring correction coefficient calculating means calculates a misfiring correction coefficient for each of different positions in relation to a misfiring nozzle.

3. The image recording device according to claim 1, wherein:

the misfiring correction coefficient calculating means comprises a look-up table that stores a plurality of misfiring correction coefficients, and an index table that relates each recording element and misfiring correction coefficient stored in the look-up table for each of different positions in relation to a misfiring nozzle; and the index table correlates an identical misfiring correction coefficient for misfiring correction coefficients within a certain range stored in the look-up table.

4. The image recording device according to claim 1, wherein the non-uniformity correction coefficient calculating means calculates the non-uniformity correction coefficient based on correction conditions that reduce low-frequency components of a power spectrum representing spatial frequency characteristics of density non-uniformity.

5. The image recording device according to claim 4, wherein the correction conditions are those where differential coefficients at a frequency origin point in the power spectrum representing the spatial frequency characteristics of the density non-uniformity become substantially zero.

6. The image recording device according to claim 5, wherein the correction conditions are expressed by N simultaneous equations obtained according to conditions for preserving a DC component of the spatial frequency, and conditions at which the differential coefficients up to (N−1)-th order become substantially zero.

7. An image recording method of recording an image on a recording medium according to image data including pixel density data using a recording head having a plurality of recording elements for discharging ink drops, the image recording method comprising:

a non-uniformity information acquiring step for acquiring non-uniformity information of each recording element by using a test pattern;

a non-uniformity correction coefficient calculating step for calculating a non-uniformity correction coefficient value for each density based on the acquired non-uniformity information of each recording element as recording characteristics of the recording element;

a misfiring correction coefficient calculating step for calculating a misfiring correction coefficient value for each density in a case where a nearby recording element is misfiring based on the acquired non-uniformity information of each recording element as the recording characteristics of the recording element;

a misfiring information detecting step for detecting misfiring information of the recording elements;

a selecting step for selecting the recording characteristics calculated by the non-uniformity correction coefficient calculating step. for each recording element a nearby recording element of which is not determined to be misfiring and for selecting the recording characteristics calculated by the misfiring correction coefficient calculating step for each recording element a nearby recording element of which is determined to he misfiring based on the pixel density data and the detected misfiring information:

a correcting step for correcting the pixel density data of the image data using the selected recording characteristics; and a drive step for driving the recording element based on the image data including the corrected pixel density data.

* * * * *